US011037486B2

(12) United States Patent
Kim

(10) Patent No.: US 11,037,486 B2
(45) Date of Patent: Jun. 15, 2021

(54) PIXEL AND LIGHT EMITTING DISPLAY APPARATUS COMPRISING THE SAME

(71) Applicant: LG Display Co., Ltd., Seoul (KR)

(72) Inventor: Hyoung-Su Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/661,274

(22) Filed: Oct. 23, 2019

(65) Prior Publication Data

US 2020/0135091 A1 Apr. 30, 2020

(30) Foreign Application Priority Data

Oct. 30, 2018 (KR) ..... 10-2018-0130952

(51) Int. Cl.
*G09G 3/32* (2016.01)

(52) U.S. Cl.
CPC ..... *G09G 3/32* (2013.01); *G09G 2300/0408* (2013.01); *G09G 2300/0452* (2013.01); *G09G 2320/0233* (2013.01)

(58) Field of Classification Search
CPC ..... G09G 3/32; G09G 2300/0408; G09G 2300/0452; G09G 2320/0233
See application file for complete search history.

(56) References Cited

U.S. PATENT DOCUMENTS 9,853,068 B2 12/2017 Miyake
2015/0171156 A1* 6/2015 Miyake ..... H01L 27/1255 257/43
2016/0240132 A1* 8/2016 Takahiro ..... G09G 3/325

FOREIGN PATENT DOCUMENTS

KR 10-2015-0068909 A 6/2015

* cited by examiner

*Primary Examiner* — Robert J Michaud
(74) *Attorney, Agent, or Firm* — Seed Intellectual Property Law Group LLP

(57) ABSTRACT

A pixel is provided that has an internal compensation circuit capable of compensating for a threshold voltage of a driving transistor without loss of a data voltage and a light emitting display apparatus including the same. The pixel includes a light emitting device and a pixel circuit connected to the light emitting device. The pixel circuit includes a driving transistor including first and second gate electrodes, a source electrode, and a drain electrode, a first capacitor formed between the first gate electrode and the source electrode of the driving transistor, a second capacitor formed between the second gate electrode and the source electrode of the driving transistor, and a switching circuit connected to the first and second gate electrodes, the source electrode, and the drain electrode of the driving transistor and operating in order of a first to a fourth period.

20 Claims, 10 Drawing Sheets

PIXEL AND LIGHT EMITTING DISPLAY APPARATUS COMPRISING THE SAME

CROSS-REFERENCE TO RELATED APPLICATIONS

This application claims the benefit of the Korean Patent Application No. 10-2018-0130952 filed on Oct. 30, 2018, which is hereby incorporated by reference as if fully set forth herein.

BACKGROUND

Technical Field

The present disclosure relates to a pixel and a light emitting display apparatus including the same.

Description of the Related Art

In the field of display apparatuses, liquid crystal display apparatuses which is light in weight and consumes less power have been widely used but these liquid crystal display apparatuses disadvantageously require a separate light source such as a backlight. Unlike liquid crystal display apparatuses, light emitting display apparatuses display an image using a self-luminous device and thus have a high response speed, consume less power, and are free of a problem in a viewing angle, and as such, light emitting display apparatuses have come to prominence as next-generation display apparatuses.

A general light emitting display apparatus includes a pixel circuit formed at each pixel. The pixel circuit causes a light emitting device to emit light by controlling a magnitude of a current flowing from a driving power source to the light emitting device using switching of a driving transistor on the basis of a data voltage, thereby displaying a certain image.

In a general light emitting display apparatus, a current flowing in the light emitting device of each pixel may be changed by a threshold voltage variation of the driving transistor or the like due to a process variation or the like. Therefore, in the pixel circuit of the general light emitting display apparatus, even if the same data voltage is applied, a data current output from the driving transistor is different in each pixel, and thus, uniform image quality cannot be realized.

BRIEF SUMMARY

Accordingly, the present disclosure is directed to providing a pixel and a light emitting display apparatus that substantially obviate one or more problems due to limitations and disadvantages of the related art.

An aspect of the present disclosure is directed to providing a pixel having an internal compensation circuit capable of compensating for a threshold voltage of a driving transistor without loss of a data voltage and a light emitting display apparatus including the same.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and according to the purpose of the disclosure, as embodied and broadly described herein, there is provided a pixel including: a light emitting device; and a pixel circuit connected to the light emitting device. The pixel circuit includes: a driving transistor including first and second gate electrodes, a source electrode, and a drain electrode; a first capacitor formed between the first gate electrode and the source electrode of the driving transistor; a second capacitor formed between the second gate electrode and the source electrode of the driving transistor; and switching circuitry connected to the first and second gate electrodes, the source electrode, and the drain electrode of the driving transistor, the switching circuitry configured to operate in order of a first to a fourth period. In operation, the switching circuitry supplies a data voltage to the first capacitor and supplies an initialization voltage to the second capacitor during the first period, floats each of the first gate electrode and the source electrode of the driving transistor and supplies the initialization voltage to the second gate electrode of the driving transistor during the second period, supplies a reference voltage to the first gate electrode of the driving transistor and supplies a pixel driving voltage to the drain electrode of the driving transistor during the third period, and floats each of the first gate electrode and the second gate electrode of the driving transistor and supplies the pixel driving voltage to the drain electrode of the driving transistor during the fourth period.

In another aspect of the present disclosure, there is provided a light emitting display apparatus including a display panel having a plurality of pixels, a data driving circuit configured to supply a data voltage or a reference voltage to each of the pixels, and a gate driving circuit configured to supply a scan pulse for operating the pixels in order of first to fourth periods to the pixels. Each of the pixel includes: a light emitting device; and a pixel circuit connected to the light emitting device. The pixel circuit includes: a driving transistor including first and second gate electrodes, a source electrode, and a drain electrode; a first capacitor formed between the first gate electrode and the source electrode of the driving transistor; a second capacitor formed between the second gate electrode and the source electrode of the driving transistor; and switching circuitry connected to the first and second gate electrodes, the source electrode, and the drain electrode of the driving transistor, the switching circuitry configured to operate in order of the first to the fourth period. In operation, the switching circuitry supplies the data voltage to the first capacitor and supplies an initialization voltage to the second capacitor during the first period, floats each of the first gate electrode and the source electrode of the driving transistor and supplies the initialization voltage to the second gate electrode of the driving transistor during the second period, supplies the reference voltage to the first gate electrode of the driving transistor and supplies a pixel driving voltage to the drain electrode of the driving transistor during the third period, and floats each of the first gate electrode and the second gate electrode of the driving transistor and supplies the pixel driving voltage to the drain electrode of the driving transistor during the fourth period.

The present disclosure may provide a pixel having an internal compensation circuit capable of compensating a threshold voltage of a driving transistor without loss of a data voltage, and a light emitting display apparatus including the same.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a portion of this application, illustrate embodiments of the disclosure and together with the description serve to explain the principle of the disclosure. In the drawings.

DETAILED DESCRIPTION

Figure 1:
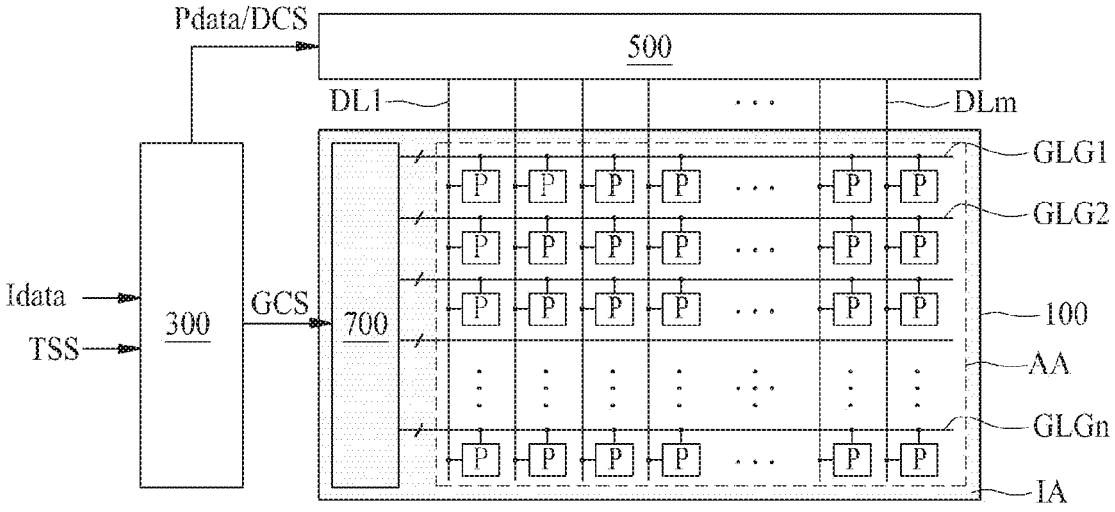
FIG. 1 is a view showing a light emitting display apparatus according to an embodiment of the present disclosure.

Reference will now be made in detail to the embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known technology is determined to unnecessarily obscure the important point of the present disclosure, the detailed description will be omitted.

In a case where 'comprise,' 'have,' and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~,' 'over~,' 'under~,' and 'next~,' one or more other parts may be disposed between the two parts unless 'just' or 'direct' is used.

In describing a time relationship, for example, when the temporal order is described as 'after~,' 'subsequent~,' 'next~,' and 'before~,' a case which is not continuous may be included unless 'just' or 'direct' is used.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of a pixel and a light emitting display apparatus including the same according to the present disclosure will be described in detail with reference to the accompanying drawings. In adding reference numerals to elements of each of the drawings, although the same elements are illustrated in other drawings, like reference numerals may refer to like elements.

FIG. 1 is a view showing a light emitting display apparatus according to an embodiment of the present disclosure.

Referring to FIG. 1, a light emitting display apparatus according to an embodiment of the present disclosure includes a light emitting display panel 100, a timing controller 300, a data driving circuit 500, and a gate driving circuit 700.

The light emitting display panel 100 includes a display area AA (or an active area) defined on a substrate and a non-display area IA (or an inactive area) surrounding the display area AA.

The display area AA may include a plurality of pixels P formed in pixel areas defined by intersection of a plurality of gate line groups GLG1 to GLGn and a plurality of data lines DL1 to DLm.

Each of the plurality of gate line groups GLG1 to GLGn may include a plurality of gate lines. For example, each of the plurality of gate line groups GLG1 to GLGn may include first to third gate lines.

Each of the plurality of data lines DL1 to DLm may be arranged to be spaced apart from each other and intersect the gate line groups GLG1 to GLGn.

Each of the plurality of pixels P includes a light emitting device and a pixel circuit causing the light emitting device to emit light on the basis of a plurality of scan pulses supplied from an adjacent gate line group GLG1 to GLGn and a data voltage supplied from adjacent data lines DL1 to DLm.

The pixels P according to an embodiment may be formed in a stripe structure on the display area AA. Here, one pixel P may include a red sub-pixel, a green sub-pixel, and a blue sub-pixel, and may further include a white sub-pixel.

The pixels P according to another example may be formed in a pentile structure on the display area AA. Here, one pixel P may include at least one red sub-pixel, at least one green sub-pixel, and at least one blue sub-pixel arranged in a planar polygonal shape. For example, the pixels P having a pentile structure may be arranged such that one red sub-pixel, two green sub-pixels, and one blue sub-pixel have an octagonal shape in a plan view, and in this case, the blue sub-pixel has the largest size and the green sub-pixel may have the smallest size.

The non-display area IA may be provided along the edge of the substrate so as to surround the display area AA. One non-display area of the non-display area IA may include a pad portion provided on the substrate and connected to the plurality of data lines DL1 to DLm.

The timing controller 300 may generate pixel-by-pixel data Pdata by aligning the input image data Idata so as to be suitable for driving the light emitting display panel 100 and generate a data control signal DCS on the basis of an input timing synchronization signal TSS and provide the generated data control signal DCS to the data driving circuit 500.

The timing controller 300 may generate a gate control signal GCS including a gate start signal and a plurality of gate clock signals on the basis of the timing synchronization signal TSS and provide the gate control signal GCS to the gate driving circuit 700.

The data driving circuit 500 may be connected to a plurality of data lines DL1 to DLm provided in the light emitting display panel 100. The data driving circuit 300 may convert digital data for each pixel into an analog type data voltage for each pixel using the digital data Pdata for each pixel, the data control signal DCS, and a plurality of reference gamma voltages provided from the timing controller 300, and supply the converted data voltage for each pixel to the corresponding data lines DL1 to DLm.

The data driving circuit 500 according to an embodiment alternately supplies the reference voltage and the data voltage for each pixel to the data lines DL1 to DLm on the basis of an operation timing of the pixel P. For example, the data driving circuit 500 according to an embodiment may supply the reference voltage to the data lines DL1 to DLm during a first sub-horizontal period of 1 horizontal period and supply the data voltage for each pixel to the data lines DL1 to DLm during the remaining second sub-horizontal period of 1 horizontal period. Here, the first sub-horizontal period and the second sub-horizontal period of 1 horizontal period may be the same or different, and the second sub-horizontal period may be set on the basis of a charge time of the data voltage for each pixel P.

The data driving circuit 500 according to an embodiment may be supplied with the reference voltage from an external power supply circuit and supply the reference voltage to the data lines DL1 to DLm. The data driving circuit 500 according to another example may generate the reference voltage by itself and supply the generated reference voltage to the data lines DL1 to DLm. For example, the data driving circuit 500 may use one of the plurality of reference gamma voltages as a reference voltage. As another example, the data driving circuit 500 may use one of the gamma voltages for each gray level generated on the basis of the plurality of reference gamma voltages as a reference voltage. As another example, the data driving circuit 500 may use a low logic driving voltage, a ground voltage, or a low potential voltage as a reference voltage.

The gate driving circuit 700 is electrically connected to the plurality of gate line groups GLG1 to GLGn. The gate driving circuit 700 may generate a plurality of scan pulses having a gate-on voltage level corresponding to an operation timing of the pixel P on the basis of a gate clock signal having the same period and sequentially shifted in phase, and supply the generated scan pulses the corresponding gate line groups GLG1 to GLGn sequentially.

The gate driving circuit 700 may be formed in the left and/or right non-display area of the substrate together with a manufacturing process of a thin film transistor (TFT) of the pixel P. As an example, the gate driving circuit 700 may be formed in a left non-display area of the substrate and operate according to a single feeding method to supply a scan pulse to each of the plurality of gate line groups GLG1 to GLGn. As another example, the gate driving circuit 700 may be formed in the left and right non-display areas of the substrate and operate according to a double feeding method to apply a scan pulse to each of the plurality of gate line groups GLG1 to GLGn. As another example, the gate driving circuit 700 may be formed in each of the left and right non-display areas of the substrate and operate according to a double feeding type interlacing method to supply a scan pulse of each of the plurality of gate line groups GLG1 to GLGn.

Figure 2:
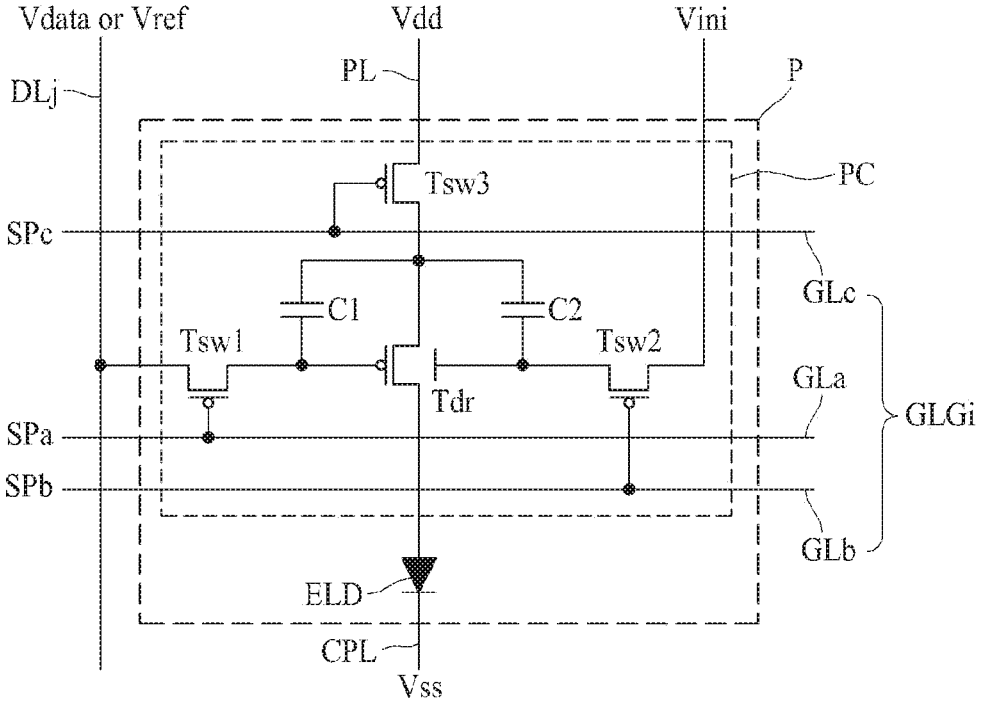
FIG. 2 is a view illustrating one pixel according to an embodiment of the present disclosure shown in FIG. 1.

FIG. 2 is a view showing a pixel according to an embodiment of the present disclosure shown in FIG. 1, in which a pixel P connected to an i-th gate line group GLGi and a j-th data line DLj of the light emitting display panel 100 is illustrated.

Referring to FIGS. 1 and 2, the pixel P according to an embodiment of the present disclosure may be electrically connected to a data line DLj, a gate line group GLGi, a pixel driving voltage line PL, and a common voltage line CPL.

The data line DLj is disposed in parallel with a first direction and is alternately supplied with a data voltage Vdata and a reference voltage Vref from the data driving circuit 500.

The pixel driving voltage line PL is disposed in parallel with the first direction and is supplied with a pixel driving voltage Vdd from the driving power supply unit or the data driving circuit 500.

The gate line group GLGi may include first to third gate lines GLa, GLb, and GLc arranged in parallel with a second direction perpendicular to the first direction. Each of the first to third gate lines GLa, GLb and GLc is supplied with first to third scan pulses SPa, SPb and SPc from the gate driving circuit 700, respectively. In this case, the first gate line GLa may be defined as a first scan control line, the second gate line GLb may be defined as a second scan control line, and the third gate line GLc may be defined as a light emitting control line.

The pixel P according to an embodiment may include a light emitting device ELD and a pixel circuit PC connected to the light emitting device ELD.

The light emitting device ELD may be interposed between a first electrode (or an anode electrode) connected to the pixel circuit PC and a second electrode (or a cathode electrode) connected to the common voltage line CPL.

The light emitting device ELD according to an embodiment may include an organic light emitting device, a quantum dot light emitting device, or an inorganic light emitting device or may include a micro light emitting diode device. Such a light emitting device ELD may emit light by a data voltage supplied from the pixel circuit PC.

The pixel circuit PC is connected to the pixel driving voltage line PL, the gate line group GLGi, and the data line DLj and supplies a data current based on a difference voltage Vdata-Vref between the data voltage Vdata supplied to the data line DLj and the reference voltage Vref to the light emitting device ELD.

The pixel circuit PC according to an embodiment may include a driving transistor Tdr, a first capacitor C1, a second capacitor C2, and switching circuitry (which may be referred to herein as a switching unit). In some embodiments, the switching circuitry or switching unit may include one or more transistors for performing the various functions described herein with respect to the switching unit.

The driving transistor Tdr may be a P-channel type TFT (TFT) having a four-terminal structure. The driving transistor Tdr according to an embodiment may include a first gate electrode, a second gate electrode, a semiconductor layer, a source electrode, and a drain electrode. In this case, the semiconductor layer of the driving transistor Tdr may include an oxide semiconductor material including a P-type semiconductor material, a single crystal silicon, a polycrystalline silicon, or an organic semiconductor material. The drain electrode of the driving transistor Tdr may be electrically connected directly to a first electrode of the light emitting device ELD. In the driving transistor Tdr, the first gate electrode may be represented as a gate electrode or a top gate electrode, and the second gate electrode may be represented as a back gate electrode. The driving transistor Tdr may output a data current on the basis of the difference voltage Vdata-Vef between the data voltage Vdata supplied to the data line DLj and the reference voltage Vref.

The first capacitor C1 may be formed between the first gate electrode and the source electrode of the driving transistor Tdr. The first capacitor C1 may have capacitance corresponding to an overlap size of the first gate electrode and the source electrode of the driving transistor Tdr. The first capacitor C1 may function to store the data voltage Vdata supplied to the data line DLj.

The second capacitor C2 may be formed between the second gate electrode and the source electrode of the driving transistor Tdr. The second capacitor C2 may have capacitance corresponding to an overlap size of the second gate electrode and the source electrode of the driving transistor Tdr. The second capacitor C2 may function to store a characteristic voltage, e.g., a threshold voltage, of the driving transistor Tdr.

The switching unit may be connected to the first and second gate electrodes, the source electrode, and the drain electrode of the driving transistor Tdr and operates in order of first to fourth periods to thereby control charging and discharging of the first and second capacitors C1 and C2 and control switching of the driving transistor Tdr.

The switching unit according to an embodiment supplies the data voltage Vdata to the first capacitor C1 and supplies an initialization voltage to the second capacitor C2 during the first period, thereby storing the data voltage Vdata to the first capacitor C1 and initializing a voltage of the second capacitor C2. In this case, the switching unit may store the difference voltage Vdata-Vdd between the data voltage Vdata and the pixel driving voltage Vdd in the first capacitor C1 and initializes the second capacitor C2 to a voltage of 0V (zero V). For example, the initialization voltage may have the same voltage level as the pixel driving voltage Vdd.

The switching unit according to an embodiment may float each of the first gate electrode and the source electrode of the driving transistor Tdr and supply the pixel driving voltage Vdd (or initialization voltage) to the second gate electrode of the driving transistor Tdr during the second period, whereby a threshold voltage of the driving transistor Tdr may be sampled (or sensed) and stored in the second capacitor C2.

The switching unit according to an embodiment supplies the reference voltage Vref to the first gate electrode of the driving transistor Tdr and the pixel driving voltage Vdd to the drain electrode of the driving transistor Tdr during the third period, thereby turning on the driving transistor Tdr through the difference voltage Vref-Vdd between the reference voltage Vref and the pixel driving voltage Vdd. Here, the reference voltage Vref may have a voltage level lower than the pixel driving voltage Vdd and higher than the common voltage Vss (or common cathode voltage).

The switching unit according to an embodiment floats the first gate electrode and the second gate electrode of the driving transistor Tdr and supplies the pixel driving voltage Vdd to the drain electrode of the driving transistor Tdr during the fourth period, thereby maintaining the turned-on state of the driving transistor Tdr through the voltage stored in each of the first and second capacitors C1 and C2. Accordingly, the driving transistor Tdr may supply the data current based on the difference voltage Vdata-Vref between the data voltage Vdata and the reference voltage Vref to the light emitting device ELD.

The switching unit according to an embodiment may include first through third switching transistors Tsw1, Tsw2, and Tsw3.

The first switching transistor Tsw1 may be electrically connected between the data line DLj and the first gate electrode of the driving transistor Tdr and switched according to a first scan pulse SPa supplied from the first gate line GLa to thereby supply the reference voltage Vref or the data voltage Vdata, which is supplied to the data line DLj, to the first gate electrode of the driving transistor Tdr. The first switching transistor Tsw1 may supply the data voltage Vdata, which is supplied to the data line DLj, to the first gate electrode of the driving transistor Tdr in the first period of the pixel P and supply the reference voltage Vref, which is supplied to the data line DLj, to the first gate electrode of the driving transistor Tdr in the third period of the pixel P.

The first switching transistor Tsw1 according to an embodiment may be a P-channel TFT having a three-terminal structure. For example, the first switching transistor Tsw1 may include a gate electrode electrically connected to the first gate line GLa, a first source/drain electrode electrically connected to the data line DLj, and a second source/drain electrode electrically connected to the first gate electrode of the driving transistor Tdr.

The second switching transistor Tsw2 may be electrically connected between the initialization voltage line Vini and the second gate electrode of the driving transistor Tdr and is switched according to a second scan pulse SPb supplied from the second gate line GLb to thereby supply the initialization voltage Vini to the second gate electrode of the driving transistor Tdr. The second switching transistor Tsw2 may supply the initialization voltage Vini, which is supplied to the initialization voltage line Vini, to the second gate electrode of the driving transistor Tdr in the first period and the second period of the pixel P.

The second switching transistor Tsw2 according to an embodiment may be a P-channel type TFT having a three-terminal structure. For example, the second switching transistor Tsw2 may include a gate electrode electrically connected to the second gate line GLb, a first source/drain electrode electrically connected to the initialization voltage line Vini, and a second source/drain electrode electrically connected to the second gate electrode of the driving transistor Tdr.

Alternatively, the initialization voltage line Vini may be electrically connected to the pixel driving voltage line PL in the pixel P, and in this case, the second switching transistor Tsw2 may provide the pixel driving voltage Vdd, which is supplied to the pixel driving voltage line PL, to the second gate electrode of the driving transistor Tdr, as the initialization voltage Vini in the first period and the second period.

The third switching transistor Tsw3 may be electrically connected between the pixel driving voltage line PL and the source electrode of the driving transistor Tdr and switched according to a third scanning pulse SPc supplied from the third gate line GLc, thereby supplying the pixel driving voltage Vdd to the source electrode of the driving transistor Tdr. The third switching transistor Tsw3 may supply the pixel driving voltage Vdd to the source electrode of the driving transistor Tdr in the first period, the third period, and the fourth period, excluding the second period of the pixel P.

The third switching transistor Tsw3 according to an embodiment may be a P-channel TFT having a three-terminal structure. For example, the third switching transistor Tsw3 may include a gate electrode electrically connected to the third gate line GLc, a first source/drain electrode electrically connected to the drain electrode of the driving transistor Tdr, and a second source/drain electrode electrically connected to the pixel driving voltage line PL.

The semiconductor layers of the first to third switching transistors Tsw1, Tsw2, and Tsw3 may include an oxide semiconductor material including a P-type semiconductor material, a single crystal silicon, a polycrystalline silicon, or an organic semiconductor material. For example, the semiconductor layers of the first to third switching transistors Tsw1, Tsw2, and Tsw3 may include the same semiconductor material as the semiconductor layer of the driving transistor Tdr.

Alternatively, at least one of the first to third switching transistors Tsw1, Tsw2, and Tsw3 may be a P-channel type TFT having a four-terminal structure. In this case, at least one of the first to third switching transistors Tsw1, Tsw2, and Tsw3 may further include a back gate electrode overlapping the gate electrode and supplied with the pixel driving voltage Vdd. Here, the back gate electrode of at least one of the first to third switching transistors Tsw1, Tsw2, and Tsw3 may be formed together in the same process as the second gate electrode of the driving transistor Tdr.

Figure 3:
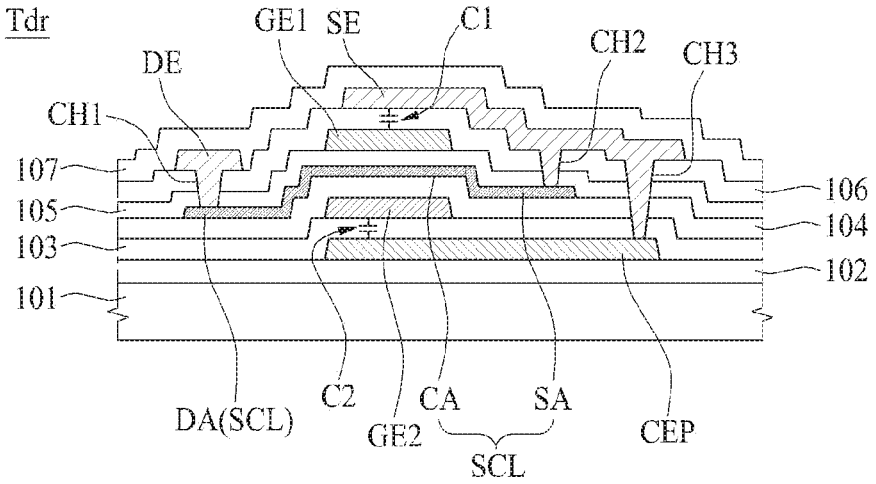
FIG. 3 is a cross-sectional view schematically showing a structure of a driving transistor shown in FIG. 2.

FIG. 3 is a cross-sectional view schematically showing a structure of the driving transistor shown in FIG. 2.

Referring to FIG. 3 in association with FIG. 2, the driving transistor Tdr according to an embodiment may include a buffer layer 102 disposed on a substrate 101, a capacitor electrode pattern CEP (or source connection electrode pattern) disposed on a driving transistor region of the buffer layer 102, a first interlayer insulating layer 103 disposed on the buffer layer 102 to cover the capacitor electrode pattern CEP, a second gate electrode GE2 disposed on the first interlayer insulating layer 103 overlapping the capacitor electrode pattern CEP, a first gate insulating layer 104 disposed on the first interlayer insulating layer 103 to cover the second gate electrode GE2, a semiconductor layer SCL disposed on the first gate insulating layer 104 overlapping the second gate electrode GE2 and having a source region SA, a channel region CA, and a drain region DA, a second gate insulating layer 105 disposed on the first gate insulating layer 104 to cover the semiconductor layer SCL, a first gate electrode GE1 disposed on the second gate insulating layer 105 overlapping the channel region CS of the semiconductor layer SCL, a second interlayer insulating layer 106 disposed on the second gate insulating layer 105 to cover the first gate electrode GE1, a drain electrode DE disposed on the second interlayer insulating layer 106 overlapping the drain region DA of the semiconductor layer SCL and electrically connected to the drain region DA of the semiconductor layer SCL, a source electrode SE disposed on the second interlayer insulating layer 106 overlapping the first gate electrode GE1 and electrically connected to each of the source region SA of the semiconductor layer SCL and the capacitor electrode pattern CEP, and a passivation layer 107 disposed on the second interlayer insulating layer 106 to cover the drain electrode DE and the source electrode SE.

The drain electrode DE may be electrically connected to the drain region DA of the semiconductor layer SCL via a first contact hole CH1 formed in the second gate insulating layer 105 overlapping the drain region DA of the semiconductor layer SCL and the second interlayer insulating layer 106.

The source electrode SE may be electrically connected to the source region SA of the semiconductor layer SCL via a second contact hole CH2 formed in the second gate insulating layer 105 overlapping with the source region SA and the second interlayer insulating layer 106. A portion of the source electrode SE may extend or protrude to overlap one side of the capacitor electrode pattern CEP and may be electrically connected to one side of the capacitor electrode pattern CEP via a third contact hole (CH3) sequentially through the second interlayer insulating layer 106 overlapping one side of the capacitor electrode pattern CEP, the second gate insulating layer 105, the first gate insulating layer 104, and the first interlayer insulating layer 103. Accordingly, the capacitor electrode pattern CEP is electrically connected to the source electrode SE, thereby serving as the source electrode SE of the driving transistor.

A first capacitor C1 may be formed in an overlap region between the first gate electrode GE1 and the source electrode SE. A second capacitor C2 may be formed in an overlap region between the capacitor electrode pattern CEP and the second gate electrode GE2. The first and second capacitors C1 and C2 are disposed at the same position with respect to a thickness direction of the substrate 101 so that the first and second capacitors C1 and C2 may have the same capacitance. Accordingly, in the present disclosure, the area occupied by the capacitors in the pixel may be reduced, thereby enabling high resolution of the pixel.

As described above, the driving transistor Tdr of the pixel according to an embodiment of the present disclosure includes the second gate electrode GE2 so that a threshold voltage may be adjusted according to a voltage applied to the second gate electrode GE2. For example, the threshold voltage of the P-channel type driving transistor Tdr may be reduced (or shifted) in a direction of negative (−) polarity when a positive (+) polarity voltage is applied to the second gate electrode GE2. According to an experiment, it was confirmed that the threshold voltage of the P-channel type driving transistor Tdr was reduced by approximately −160 mV when the voltage applied to the second gate electrode GE2 increases by +0.5 V.

Figure 4:
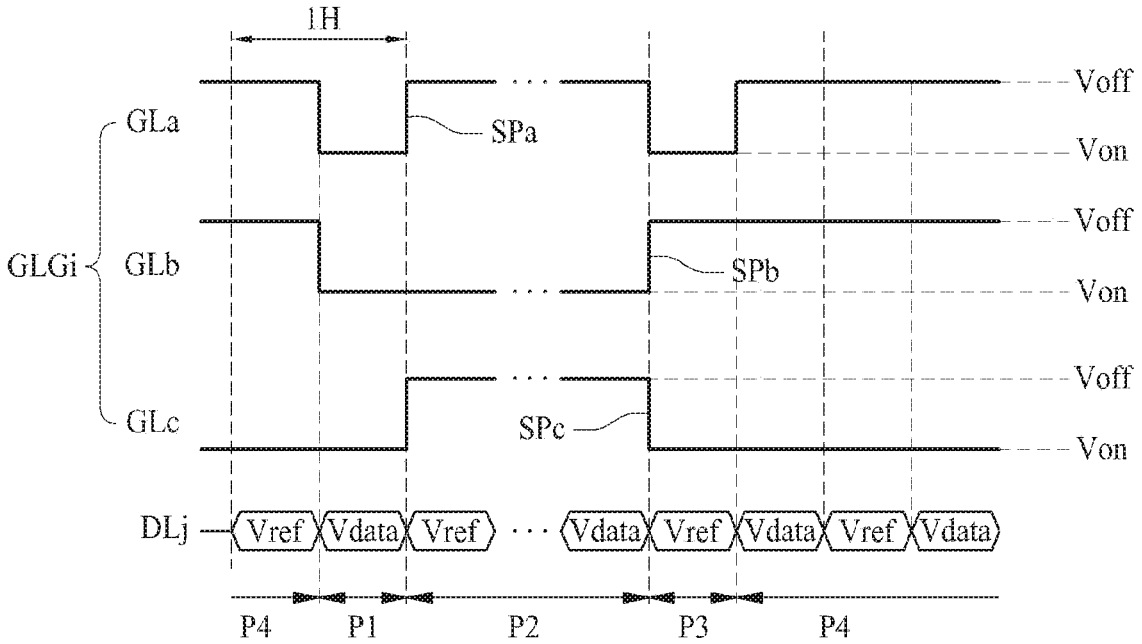
FIG. 4 is a waveform view showing signals supplied to the pixel shown in FIG. 2.

FIG. 4 is a waveform view showing signals supplied to the pixel shown in FIG. 2, FIGS. 5A to 5D are views illustrating a method of driving the pixel shown in FIG. 2, and FIGS. 6A to 6C are graphs showing transfer curve characteristics of a driving transistor according to a driving method of a pixel shown in FIG. 2.

Referring to FIG. 4, the pixel P according to an embodiment of the present disclosure may be operated in first to fourth periods P1, P2, P3, and P4. In this case, the first period P1 may be defined as an initialization and programming period (or data writing), the second period P2 may be defined as a threshold voltage sensing period, the third period P3 may be defined as a light emission preparation period (or reference voltage writing), and the fourth period P4 may be defined as a light emission sustaining period. For example, the first period P1 and the third period P3 may be set to a half (H/2) of 1 horizontal period 1H shorter than 1 horizontal period 1H, the second period P2 may be set be longer than the first period P1 and the fourth period P4 may be set to a remaining period excluding the first to third periods P1, P2, and P3 of one frame. Here, the second period P2, which is an period during which a characteristic voltage (or threshold voltage) of the driving transistor Tdr is sensed (or sampled) and stored in the second capacitor C2, may be set to be 2 horizontal periods or greater, more preferably, 19 horizontal periods or greater, to fully sense the characteristic voltage (or the threshold voltage) of the driving transistor Tdr.

First, the pixel P is supplied with the first to third scan pulses SPa, SPb and SPc from the gate line group GLGi. In this case, the first scan pulse SPa may be supplied to the first switching transistor Tsw1 of the switching unit through the first gate line GLa of the gate line group GLGi, the second scan pulse SPb may be supplied to the second switching transistor Tsw2 of the switching unit through the second gate line GLb of the gate line group GLGi, and the third scan pulse SPc may be supplied to the third switching transistor Tsw3 of the switching unit through the third gate line GLc of the gate line group GLGi.

The first scan pulse SPa may have a gate-on voltage level Von (or low level) in each of the first period P1 and the third period P3 of one frame period and have a gate-off voltage level Voff (or high level) in the remaining periods P2 and P4 except for the first period P1 and the third period P3.

The second scan pulse SPa may have a gate-on voltage level Von (or low level) in each of the first and second periods P1 and P2 of one frame period and have a gate-off voltage level Voff (or high level) in the remaining periods P3 and P4 except for the first and second periods P1 and P2.

The third scan pulse SPa may have a gate-on voltage level Von (or low level) in each of the first, third, and fourth periods P1, P3, and P4 of one frame period and have a gate-off voltage level Voff (or high level) in the remaining period P2 except for the first, third, and fourth periods P1, P3, and P4.

The data line DLj connected to the pixel P alternately receives the reference voltage Vref and the data voltage Vdata alternately from the data driving circuit. That is, in order to simplify the pixel circuit by reducing the number of the scan lines and the number of the gate lines applied to the pixel P, the reference voltage Vref for initializing the pixel circuit is supplied through the data line DLj, and accordingly, the reference voltage Vref and the data voltage Vdata are alternately supplied to the data line DLj.

Figure 5A:
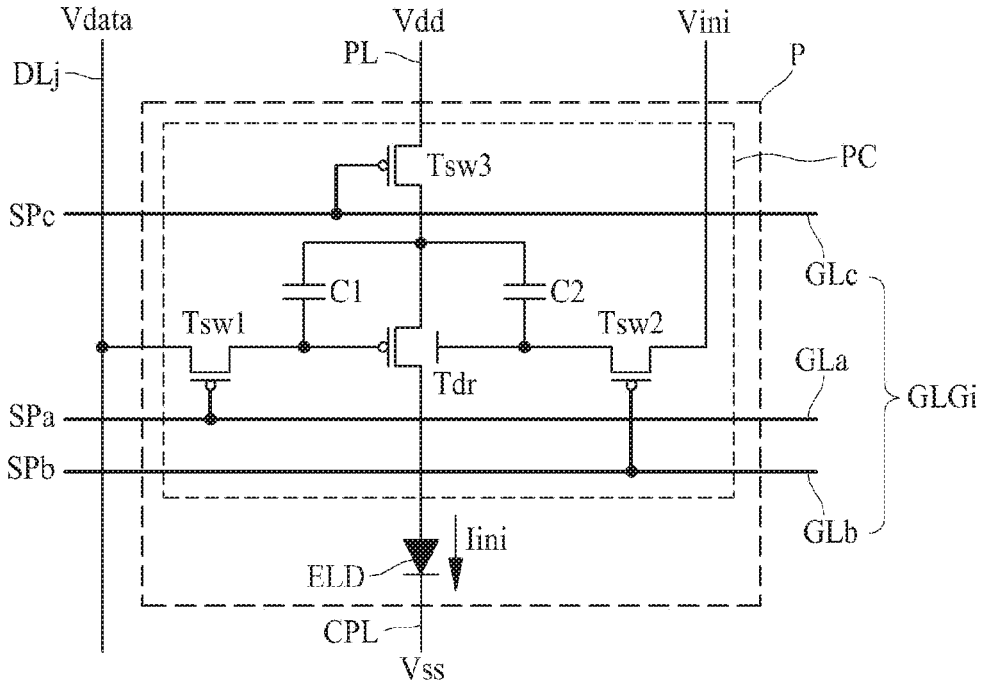
FIGS. 5A to 5D are views illustrating a method of driving the pixel shown in FIG. 2.

Referring to FIGS. 4 and 5A, the first to third switching transistors Tsw1, Tsw2, and Tsw3 may be turned on according to the first to third scan pulses SPa, SPb, and SPc having the gate-on voltage level Von in the first period P1 of the pixel P. Also, the actual data voltage Vdata may be supplied to the data line DLj from the data driving circuit. Accordingly, the actual data voltage Vdata may be supplied to the first gate electrode of the driving transistor Tdr through the turned-on first switching transistor Tsw1, and the pixel driving voltage Vdd may be supplied to the source electrode of the driving transistor Tdr through the turned-on third switching transistor Tdr and also simultaneously supplied to the second gate electrode of the driving transistor Tdr through the turned-on second switching transistor Tsw2 as an initialization voltage. Accordingly, a difference voltage Vdata-Vdd between the actual data voltage Vdata supplied to the first gate electrode of the driving transistor Tdr and the pixel driving voltage Vdd supplied to the source electrode of the driving transistor Tdr may be stored in the first capacitor C1. Also, the second capacitor C2 may be initialized to 0 (zero) V by a difference voltage Vdd-Vdd between the pixel driving voltage Vdd supplied to the second gate electrode of the driving transistor Tdr and the pixel driving voltage Vdd supplied to the source electrode of the driving transistor Tdr.

In the first period P1 of the pixel P, the driving transistor Tdr is turned on by the first gate voltage and the source voltage Vgs to thereby supply an initial data current Iini to the light emitting device ELD on the basis of the difference voltage Vdata-Vdd between the actual data voltage Vdata and the pixel driving voltage Vdd, and accordingly, the light emitting device ELD may emit light initially by the initial data current Iini. Here, when the second gate voltage and the source voltage Vbs of the driving transistor Tdr are 0 V, the driving transistor Tdr may be in a turned-on state like the transfer curve characteristic of the driving transistor Tdr shown in FIG. 6A.

Figure 5B:
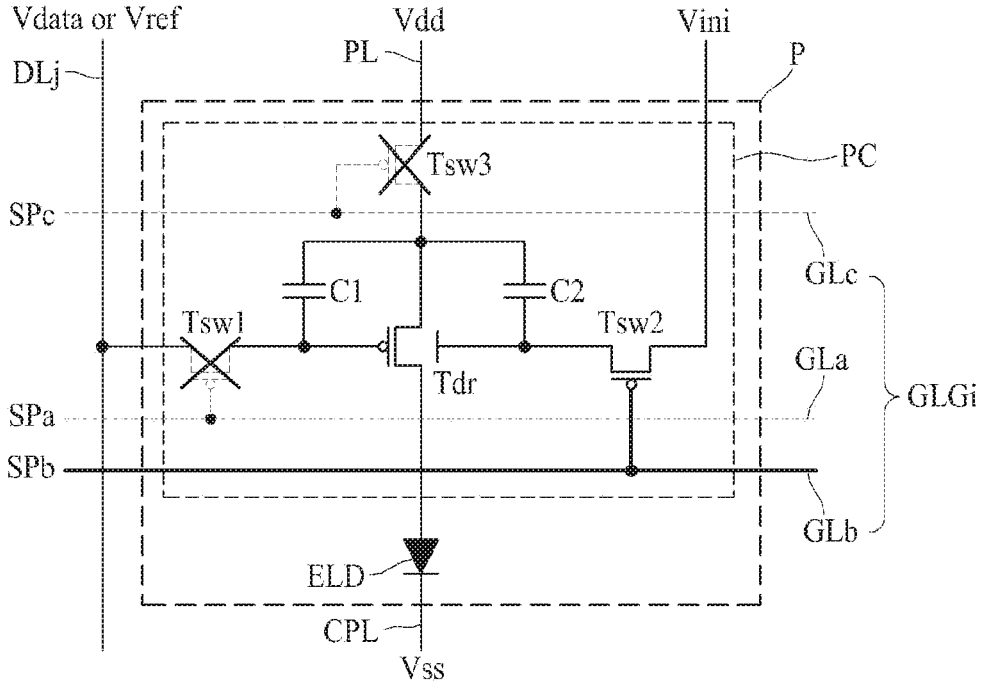

Referring to FIGS. 4 and 5B, in the second period P2 of the pixel P according to an embodiment of the present disclosure, the switching transistor Tsw2 is maintained in a turned-on state according to the second scan pulse SPb maintained at the gate-on voltage level Von, and the first and third switching transistors Tsw1 and Tsw3 may be turned off according to the first and third scan pulses SPa and SPc having the gate-off voltage level Voff, respectively. The reference voltage Vref and the data voltage Vdata may be alternately supplied from the data driving circuit to the data line DLj. Accordingly, the first gate electrode of the driving transistor Tdr is electrically floated due to the turn-off of the first switching transistor Tsw1, the source electrode of the driving transistor Tdr is electrically floated due to the turn-off of the third switching transistor Tsw3, and the second gate electrode of the driving transistor Tdr is continuously supplied with the pixel driving voltage (or initialization voltage) through the second switching transistor Tsw2 which maintains the turned-on state.

In the second period P2 of the pixel P, the source voltage Vs of the driving transistor Tdr may be dropped (or reduced) to a voltage until the driving transistor Tdr is turned off from the voltage level of the pixel driving voltage Vdd due to the turn-off of the third switching transistor Tsw3, the first gate voltage Vg of the driving transistor Tdr is changed to "Vdata-(Vdd-Vs)" due to the turn-off of the first switching transistor Tsw1 and the source voltage Vs of the driving transistor Tdr, and the second gate voltage Vg of the driving transistor Tdr may be maintained at the pixel driving voltage Vdd due to the turned-on of the second switching transistor Tsw2. Accordingly, the first capacitor C1 may be maintained at "Vdata-Vdd" by the first gate voltage-source voltage Vgs of the driving transistor Tdr, and the second capacitor C2 may store "Vdd-Vs" by the second gate voltage-source voltage Vbs of the driving transistor Tdr.

In the second period P2 of the pixel P, the driving transistor Tdr is turned off when the source voltage is dropped (or reduced) to a voltage corresponding to a threshold voltage of the driving transistor Tdr from the voltage level of the pixel driving voltage Vdd due to turn-off of the third switching transistor Tsw3. That is, the driving transistor Tdr may be turned off when the source voltage Vs is a voltage (Vdd-Vth) obtained by subtracting the threshold voltage Vth of the driving transistor Tdr from the pixel driving voltage Vdd. In a state (or condition) in which the difference voltage Vdata-Vdd between the actual data voltage Vdata and the pixel driving voltage Vdd is stored in the first capacitor C1 by the first gate voltage-source voltage Vgs of the driving transistor Tdr, the threshold voltage Vth of the driving transistor Tdr at which the driving transistor Tdr is to be turned off may be changed according to the second gate voltage-source voltage Vbs of the driving transistor Tdr as shown in Equation 1 below.

$$Vth_data = Vth - \alpha \times Vbs \quad \text{[Equation 1]}$$

In Equation (1), "α" value refers to a value at which a threshold voltage is varied by a body effect.

Figure 6A:
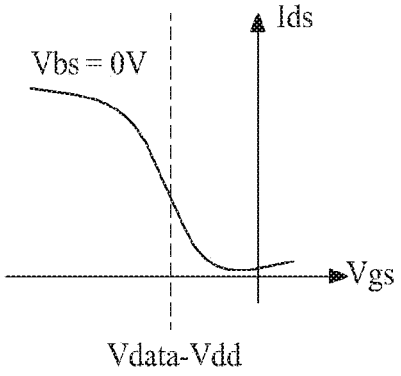
FIGS. 6A to 6C are graphs showing transfer curve characteristics of a driving transistor according to a driving method of the pixel shown in FIG. 2.
Figure 6B:
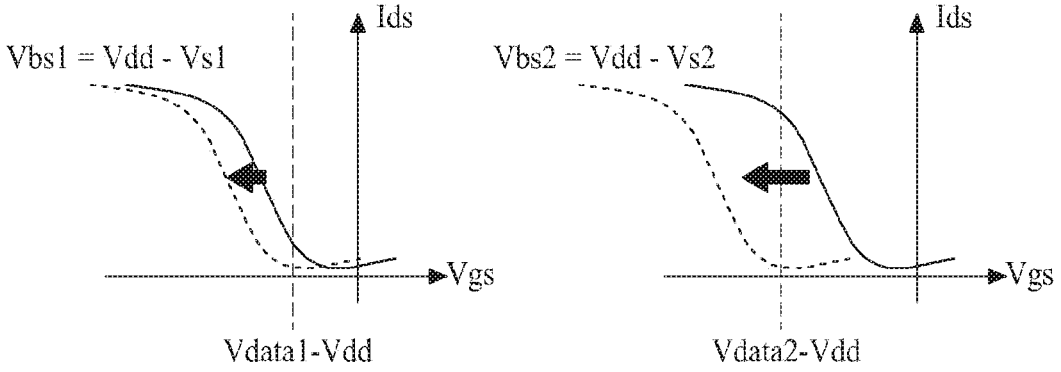

After sensing of the threshold voltage of the driving transistor Tdr is completed according to the second period P2 of the pixel P, "Vth_data" which is the threshold voltage of the driving transistor Tdr is approximately "Vdata-Vdd," the second gate voltage-source voltage Vbs of the driving transistor Tdr stored in the second capacitor C2 may be expressed as the original threshold voltage Vth of the actual data voltage Vdata and the driving transistor Tdr as shown in Equation 2 below, and since the second gate voltage-source voltage Vbs of the driving transistor Tdr increases in the positive (+) polarity direction as the actual data voltage Vdata decreases, and thus, a transfer curve of the driving transistor Tdr may be significantly shifted to the left as shown in FIG. 6B. For example, when the second data voltage Vdata2 is smaller than the first data voltage Vdata1, the second gate voltage-source voltage Vbs2 of the driving transistor Tdr according to the second data voltage Vdata2 is smaller than the second gate voltage-source voltage Vbs1 of the driving transistor Tdr according to the first data voltage Vdata1, and thus, the transfer curve of the driving transistor Tdr corresponding to the second data voltage Vdata2 may be significantly shifted in the negative (−) polarity direction.

$$Vth_data \approx Vdata - Vdd$$

$$Vbs = (Vdd - Vdata + Vth)/\alpha \quad \text{[Equation 2]}$$

As described above, the second period P2 of the pixel P may last until the source voltage Vs of the driving transistor Tdr is completely dropped (or reduced) to a voltage corresponding to the threshold voltage of the driving transistor Tdr from the voltage level of the pixel driving voltage Vdd. The second period P2 of the pixel P according to an embodiment may last for a time longer than the first period P1. For example, the second period P2 of the pixel P may last for two horizontal periods or longer, and more preferably, for 19 horizontal periods or longer.

Figure 5C:
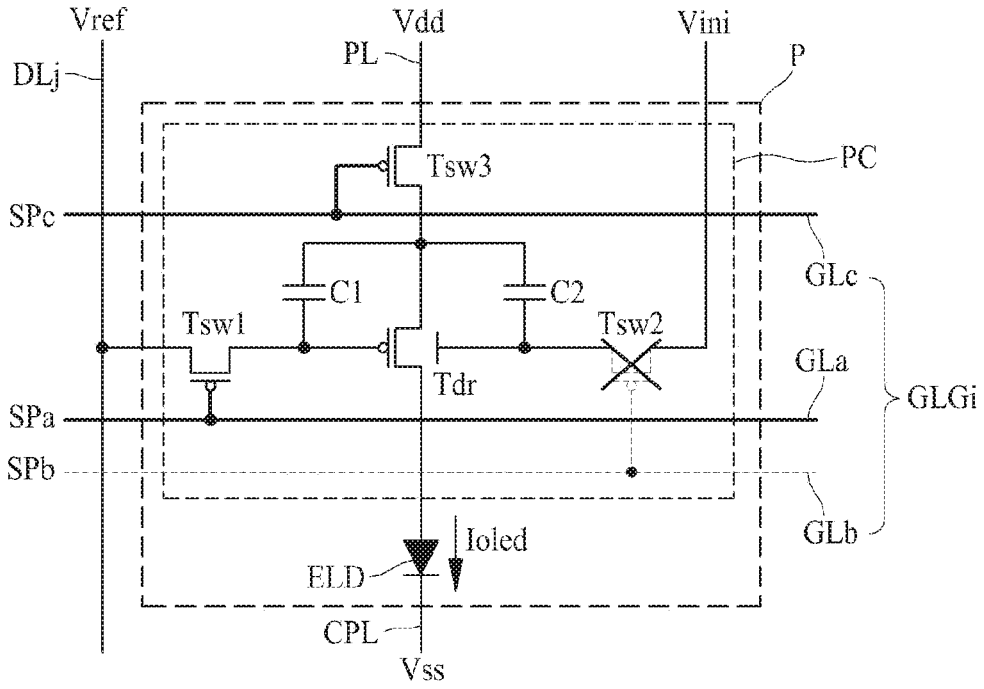

Referring to FIGS. 4 and 5C, in the third period P3 of the pixel P according to an embodiment of the present disclosure, each of the first and third switching transistors Tsw1 and Tsw3 may be turned on according to the first and third scan pulses SPa and SPc having the gate-on voltage level Von, and the second switching transistor Tsw2 may be turned off according to the second scan pulse SPb having the gate-off voltage level Voff. The data line DLj may be supplied with the reference voltage Vref from the data driving circuit. The first gate electrode of the driving transistor Tdr is supplied with the reference voltage Vref through the turned-on first switching transistor Tsw1, the second gate electrode of the driving transistor Tdr is electrically floated due to turn-off of the second switching transistor Tsw2, and the source electrode of the driving transistor Tdr is supplied with the pixel driving voltage Vdd through the turned-on third switching transistor Tsw3. Therefore, the voltage of the first capacitor C1 is changed to "Vref-Vdd" by the first gate voltage-source voltage Vgs of the driving transistor Tdr, and the voltage of the second capacitor C2 may be maintained as "Vdd-Vs" by the second gate voltage-source voltage Vbs of the driving transistor Tdr.

In the third period P3 of the pixel P, the driving transistor Tdr is turned on by the first gate voltage-source voltage Vgs to output the data current Idata as shown in Equation 3 below, and accordingly, the light emitting device ELD may start to emit light by the data current Idata.

$$Idata = k(Vdd - Vref - |Vth_data|)^2 \quad \text{[Equation 3]}$$

In Equation (3), "k" refers to a constant determined according to mobility and parasitic capacitance of the driving transistor Tdr.

After sensing of the threshold voltage in the second period P2 of the pixel P, the threshold voltage Vth_data of the driving transistor Tdr is "Vdata-Vdd," and thus, the driving transistor Tdr may supply the data current Idata on the basis of the difference voltage (Vdata-Vref) between the actual data voltage Vdata and the reference voltage Vref to the light emitting device ELD as shown in the following Equation 4.

$$Vth_data \approx Vdata - Vdd$$

$$Idata \approx k(Vdd - Vref - Vdata - Vdd)^2$$

$$Idata \approx k(Vdata - Vref)^2 \quad \text{[Equation 4]}$$

Figure 6C:
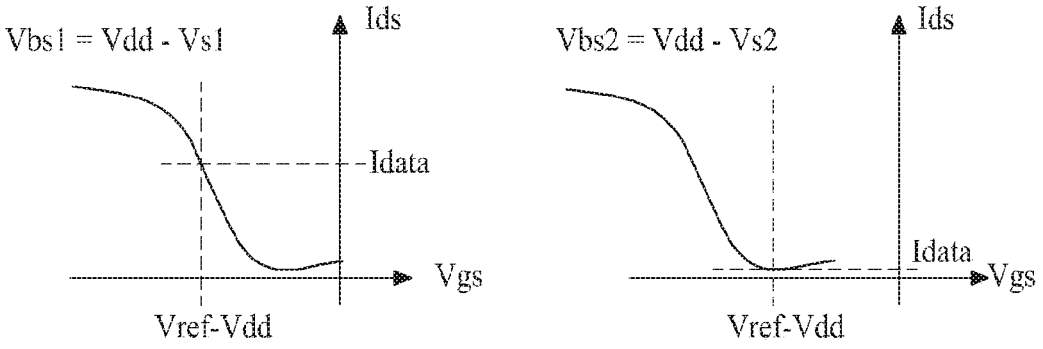

As shown in Equation 4, it can be seen that the data current Idata supplied to the light emitting device ELD is not affected by the pixel driving voltage Vdd and the threshold voltage Vth of the driving transistor Tdr and is affected by the data voltage data and the reference voltage Vref. In this case, a magnitude of the data current Idata may vary depending on the second gate voltage-source voltage Vbs of the driving transistor Tdr. That is, since the second gate voltage-source voltage Vbs of the driving transistor Tdr is close to 0 V as the actual data voltage Vdata is larger, the data current Idata may have the value of 0 (zero) when the first gate voltage Vg of the driving transistor Tdr is equal to the reference voltage Vref as shown in FIG. 6C.

Figure 5D:
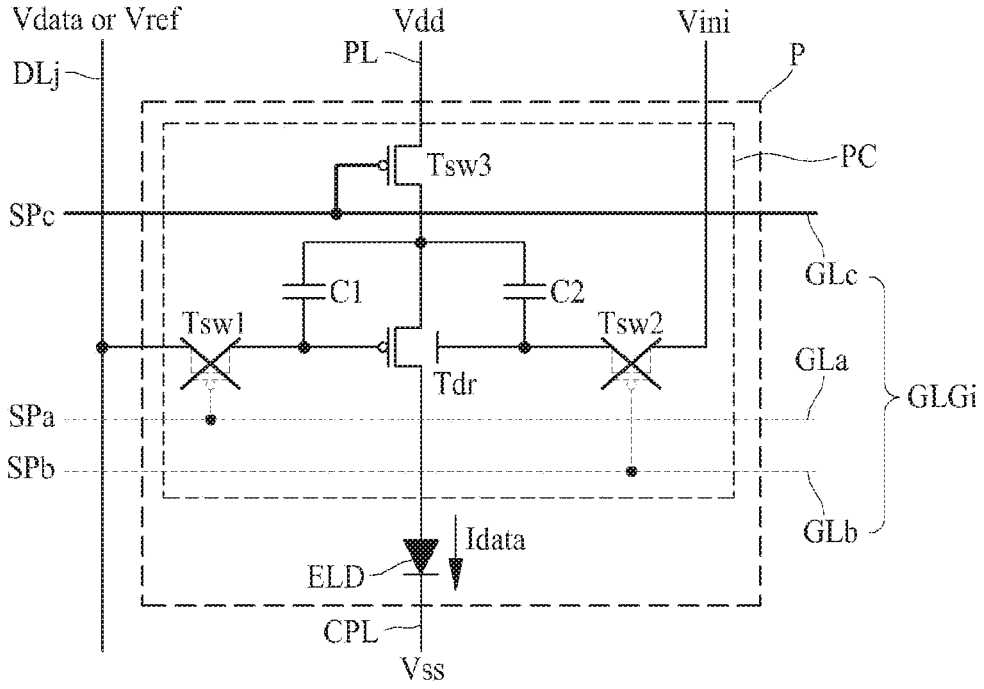

Referring to FIGS. 4 and 5D, in a fourth period P4 of the pixel P according to an embodiment of the present disclosure, the third switching transistor Tsw3 is kept in the turned-on state according to the third scan pulse SPc maintaining the gate-on voltage level Von, the second switching transistor Tsw2 is kept in the turned-off state according to the second scan pulse SPb maintaining the gate-off voltage level Voff, and the first switching transistor Tsw1 may be turned off according to the first scan pulse SPa having the gate-off voltage level Voff. The data voltage Vdata and the reference voltage Vref may be alternately supplied from the data driving circuit to the data line DLj. Accordingly, the first gate electrode of the driving transistor Tdr is electrically floated by the turn-off of the first switching transistor Tsw1, the second gate electrode of the driving transistor Tdr is kept in the electrically floated state due to the turned-off state of the second switching transistor Tsw2, the source electrode of the driving transistor Tdr is continuously supplied with the pixel driving voltage Vdd through the third switching transistor Tsw3 kept in the turned-on state. Accordingly, the voltage of the first capacitor C1 may be held at "Vref-Vdd" by the first gate voltage-source voltage Vgs of the driving transistor Tdr and the voltage of the second capacitor C2 may be held at "Vdd-Vs" by the second gate voltage-source voltage Vbs of the driving transistor Tdr.

In the fourth period P4 of the pixel P, the driving transistor Tdr is kept in the turned-on state by the first gate voltage-source voltage Vgs, thereby outputting the data voltage Idata as expressed by Equation 4, and thus, the light emitting device ELD may kept emitting light by the data current Idata.

The light emitting display apparatus according to an embodiment of the present disclosure may compensate for the threshold voltage of the driving transistor Tdr provided in each of the plurality of pixels P, and thus, a threshold voltage deviation between the driving transistors Tdr provided in each of the plurality of pixels P may be minimized. In addition, the light emitting display apparatus according to an embodiment of the present disclosure may store the data voltage Vdata in the first capacitor C1 connected between the first gate electrode and the source electrode of the driving transistor Tdr in each pixel P and store a compensation voltage for compensating for the threshold voltage of the driving transistor Tdr in the second capacitor C2 connected between the second gate electrode and the source electrode of the driving transistor Tdr, thereby minimizing loss of the data voltage Vdata and/or the compensation voltage. Also, in the light emitting display apparatus according to an embodiment of the present disclosure, the first and second capacitors C1 and C2 arranged in each pixel P are arranged at the same position with respect to the thickness direction of the substrate 101, and thus, the area occupied by the capacitors in the pixel may be reduced, thereby enabling high resolution of the pixel.

Figure 7:
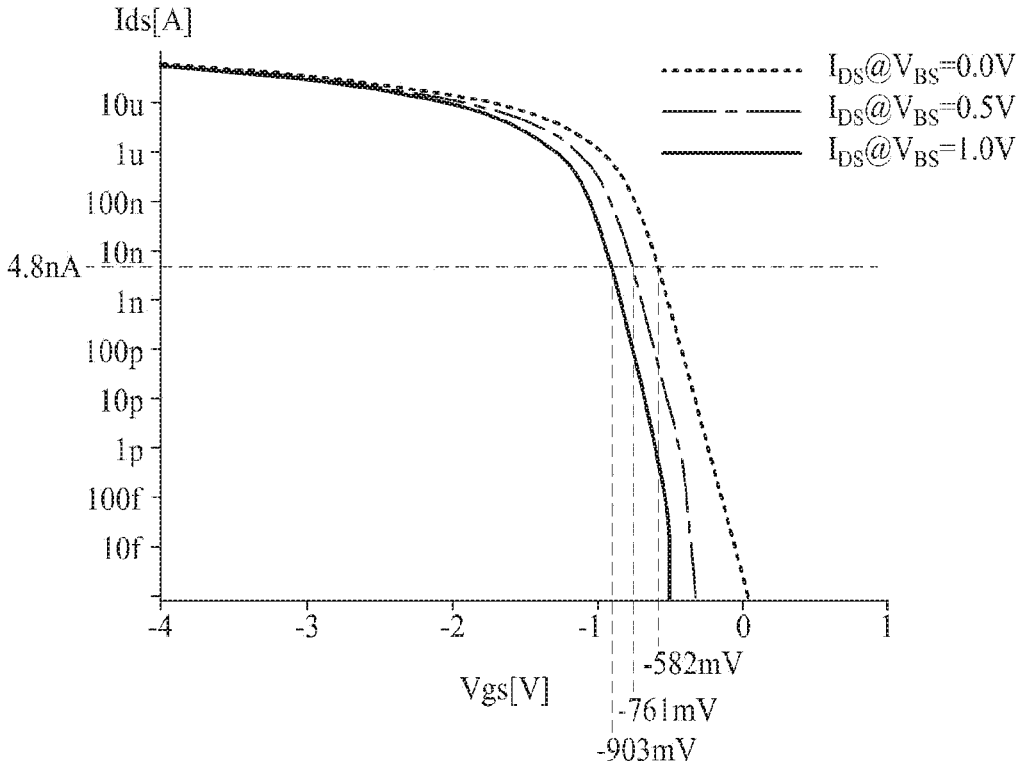
FIG. 7 is a graph showing a change in a threshold voltage according to a second gate voltage and a source voltage of a driving transistor in a light emitting display apparatus according to the present disclosure.

FIG. 7 is a graph showing a change in a threshold voltage according to a second gate voltage and a source voltage of the driving transistor in the light emitting display apparatus according to the present disclosure.

As can be seen from FIG. 7, the threshold voltage of the P-channel type driving transistor Tdr is −582 mV when the voltage Vbs between the second gate voltage and the source voltage is 0 V, −761 mV when the voltage Vbs between the second gate voltage and the source voltage is 0.5 V, and −903 mV when the voltage Vbs between the second gate voltage and the source voltage is 1.0 V. Therefore, it can be seen that the threshold voltage of the P-channel type driving transistor Tdr according to an embodiment of the present disclosure is reduced by about −160 mV when the voltage applied to the second gate electrode GE2 increases by +0.5 V.

Figure 8:
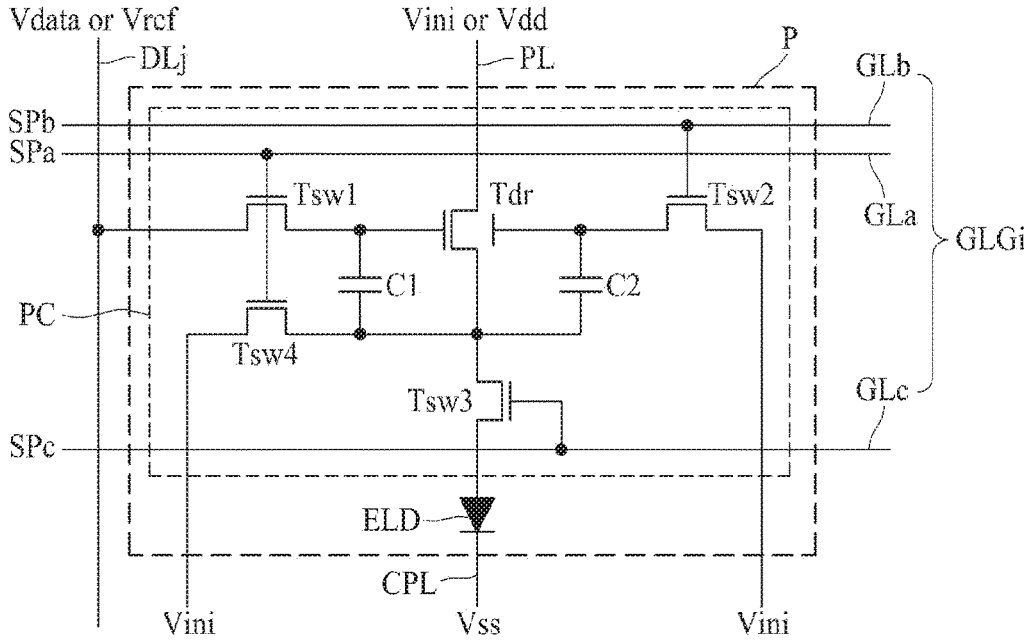
FIG. 8 is a diagram showing one pixel according to another example of the present disclosure shown in FIG. 1.

FIG. 8 shows one pixel according to another example of the present disclosure shown in FIG. 1, in which the pixel P connected to the i-th gate line group GLGi and the j-th data line DLj of the light emitting display panel 100 is illustrated.

Referring to FIGS. 1 and 8, the pixel P according to another example of the present disclosure may include a light emitting device ELD and a pixel circuit PC connected to the light emitting device ELD. The pixel P according to another example of the present disclosure may be electrically connected to the data line DLj, the gate line group GLGi, the pixel driving voltage line PL, and the common voltage line CPL. Here, the connection of the pixel P is substantially the same as the pixel P according to an embodiment shown in FIGS. 1 and 2, and thus, a redundant description thereof will be omitted.

The light emitting device ELD may be interposed between a first electrode (or an anode electrode) connected to the pixel circuit PC and a second electrode (or a cathode electrode) connected to the common voltage line CPL.

The light emitting device ELD according to an embodiment may include an organic light emitting device, a quantum dot light emitting device, or an inorganic light emitting device or may include a micro light emitting diode device. Such a light emitting device ELD may emit light by a data voltage supplied from the pixel circuit PC.

The pixel circuit PC is connected to the pixel driving voltage line PL, the gate line group GLGi, and the data line DLj and supplies a data current based on a difference voltage Vdata-Vref between the data voltage Vdata supplied to the data line DLj and the reference voltage Vref to the light emitting device ELD.

The pixel circuit PC according to an embodiment may include a driving transistor Tdr, a first capacitor C1, a second capacitor C2, and a switching unit.

The driving transistor Tdr is substantially the same as the driving transistor Tdr shown in FIGS. 2 and 3 except that the driving transistor Tdr is configured as an N-channel type TFT having a four-terminal structure, and thus, a redundant description thereof will be omitted. The driving transistor Tdr may output a data current on the basis of a difference voltage Vref-Vdata between the reference voltage Vref supplied to the data line DLj and the data voltage Vdata.

The drain electrode of the driving transistor Tdr according to the present example may be electrically connected to the pixel driving voltage line PL and may be supplied with the initialization voltage Vini or the pixel driving voltage Vdd from the pixel driving voltage line PL.

The first capacitor C1 is formed between the first gate electrode and the source electrode of the driving transistor Tdr and stores the data voltage Vdata supplied to the data line DLj, which is substantially the same as the first capacitor C1 shown in FIGS. 2 and 3, and thus, a redundant description thereof will be omitted.

The second capacitor C2 is formed between the second gate electrode and the source electrode of the driving transistor Tdr and stores a characteristic voltage, for example, a threshold voltage, of the driving transistor Tdr, which is the same as the second capacitor C2 shown in FIGS. 2 and 3, and thus, a redundant description thereof will be omitted.

The switching unit may be connected to the first and second gate electrodes, the source electrode, and the drain electrode of the driving transistor Tdr and operates in order of first to fourth periods to thereby control charging and discharging of the first and second capacitors C1 and C2 and control switching of the driving transistor Tdr.

The switching unit according to an embodiment supplies the data voltage Vdata to the first capacitor C1 and supplies an initialization voltage Vini to the second capacitor C2 during the first period, thereby storing the data voltage Vdata to the first capacitor C1 and initializing a voltage of the second capacitor C2. In this case, the switching unit may store the difference voltage Vdata-Vini between the data voltage Vdata and the initialization voltage Vini in the first capacitor C1 and initializes the second capacitor C2 to a voltage of 0V (zero V). For example, the initialization voltage Vini may have the same voltage level as the ground voltage or the common voltage Vss. In this case, the ground voltage may have a voltage level lower than the reference voltage and a voltage level equal to or higher than the common voltage Vss.

The switching unit according to an embodiment may float each of the first gate electrode and the source electrode of the driving transistor Tdr and supply the initialization voltage Vini to the second gate electrode of the driving transistor Tdr during the second period, whereby a threshold voltage of the driving transistor Tdr may be sampled (or sensed) and stored in the second capacitor C2.

The switching unit supplies the reference voltage Vref to the first gate electrode of the driving transistor Tdr, supplies the pixel driving voltage Vdd to the drain electrode of the driving transistor Tdr, supplies the initialization voltage Vini to the source electrode of the driving transistor Tdr, and electrically floats the second gate electrode of the driving transistor Tdr during the third period, whereby the driving transistor Tdr may be turned on through the difference voltage Vref-Vini between the reference voltage Vref and the initialization voltage Vini. Here, the reference voltage Vref may have a voltage level lower than the pixel driving voltage Vdd and higher than the common voltage Vss (or common cathode voltage) and may have a voltage level higher than the initialization voltage Vini.

The switching unit according to an embodiment floats the first gate electrode and the second gate electrode of the driving transistor Tdr and supplies the pixel driving voltage Vdd to the drain electrode of the driving transistor Tdr during the fourth period, thereby maintaining the turned-on state of the driving transistor Tdr through the voltage stored in each of the first and second capacitors C1 and C2. Accordingly, the driving transistor Tdr may supply the data current based on the difference voltage Vref-Vdata between the reference voltage Vref and the data voltage Vdata to the light emitting device ELD.

The switching unit according to an embodiment may include first to fourth switching transistors Tsw1, Tsw2, Tsw3, and Tsw4.

The first switching transistor Tsw1 may be electrically connected between the data line DLj and the first gate electrode of the driving transistor Tdr and switched according to a first scan pulse SPa supplied from the first gate line GLa to thereby supply the reference voltage Vref or the data voltage Vdata, which is supplied to the data line DLj, to the first gate electrode of the driving transistor Tdr. The first switching transistor Tsw1 may supply the data voltage Vdata, which is supplied to the data line DLj, to the first gate electrode of the driving transistor Tdr in the first period of the pixel P and supply the reference voltage Vref, which is supplied to the data line DLj, to the first gate electrode of the driving transistor Tdr in the third period of the pixel P.

The first switching transistor Tsw1 according to an embodiment may be an N-channel TFT having a three-terminal structure. For example, the first switching transistor Tsw1 may include a gate electrode electrically connected to the first gate line GLa, a first source/drain electrode electrically connected to the data line DLj, and a second source/drain electrode electrically connected to the first gate electrode of the driving transistor Tdr.

The second switching transistor Tsw2 may be electrically connected between the initialization voltage line Vini and the second gate electrode of the driving transistor Tdr and is switched according to a second scan pulse SPb to thereby supply the initialization voltage Vini to the second gate electrode of the driving transistor Tdr. The second switching transistor Tsw2 may supply the initialization voltage Vini, which is supplied to the initialization voltage line Vini, to the second gate electrode of the driving transistor Tdr in the first period and the second period of the pixel P.

The second switching transistor Tsw2 according to an embodiment may be an N-channel type TFT having a three-terminal structure. For example, the second switching transistor Tsw2 may include a gate electrode electrically connected to the second gate line GLb, a first source/drain electrode electrically connected to the initialization voltage line Vini, and a second source/drain electrode electrically connected to the second gate electrode.

The third switching transistor Tsw3 may be electrically connected between the first electrode of the light emitting device ELD and the source electrode of the driving transistor Tdr and switched according to a third scanning pulse SPc supplied from the third gate line GLc, thereby supplying a data current output from the driving transistor Tdr to the light emitting device ELD. The third switching transistor Tsw3 may electrically connect the source electrode of the driving transistor Tdr to the first electrode of the light emitting device ELD in the first period, the third period, and the fourth period, excluding the second period of the pixel P.

The third switching transistor Tsw3 according to an embodiment may be a P-channel TFT having a three-terminal structure. For example, the third switching transistor Tsw3 may include a gate electrode electrically connected to the third gate line GLc, a first source/drain electrode electrically connected to the source electrode of the driving transistor Tdr, and a second source/drain electrode electrically connected to the first electrode of the light emitting device ELD.

The fourth switching transistor Tsw4 may be electrically connected between the initialization voltage line Vini and the source electrode of the driving transistor Tdr and is switched according to a first scan pulse SPa supplied from the first gate line GLa to thereby supply the initialization voltage Vini to the second gate electrode of the driving transistor Tdr. The fourth switching transistor Tsw4 may supply the initialization voltage Vini, which is supplied to the initialization voltage line Vini, to the source electrode of the driving transistor Tdr in the first period and the third period of the pixel P.

The fourth switching transistor Tsw4 according to an embodiment may be an N-channel TFT having a three-terminal structure. For example, the fourth switching transistor Tsw4 may include a gate electrode electrically connected to the first gate line GLa, a first source/drain electrode electrically connected to the initialization voltage line Vini, and a second source/drain electrode electrically connected to the source electrode of the driving transistor Tdr.

Alternatively, the initialization voltage line Vini may be electrically connected to the common voltage line CPL in the pixel P. In this case, the second switching transistor Tsw2 may provide the common voltage, which is supplied to the common voltage line CPL, to the second gate electrode of the driving transistor Tdr, as the initialization voltage Vini in the first period and the second period. Also, the fourth switching transistor Tsw4 may supply the common voltage, which is supplied to the common voltage line CPL, to the source electrode of the driving transistor Tdr as an initialization voltage Vini in the first period and the third period of the pixel P.

The semiconductor layers of the first to fourth switching transistors Tsw1, Tsw2, Tsw3, and Tsw4 may include an oxide semiconductor material including an N-type semiconductor material, a single crystal silicon, a polycrystalline silicon, or an organic semiconductor material. For example, the semiconductor layers of the first to fourth switching transistors Tsw1, Tsw2, Tsw3, and Tsw4 may include the same semiconductor material as the semiconductor layer of the driving transistor Tdr.

Alternatively, at least one of the first through fourth switching transistors Tsw1, Tsw2, Tsw3, and Tsw4 may be an N-channel TFT having a four-terminal structure. In this case, at least one of the first to fourth switching transistors Tsw1, Tsw2, Tsw3, and Tsw4 may further include a back gate electrode overlapping the gate electrode and supplied with the initialization voltage Vini. Here, the back gate electrode of at least one of the first to fourth switching transistors Tsw1, Tsw2, Tsw3, and Tsw4 may be formed together in the same process as the second gate electrode of the driving transistor Tdr.

Figure 9:
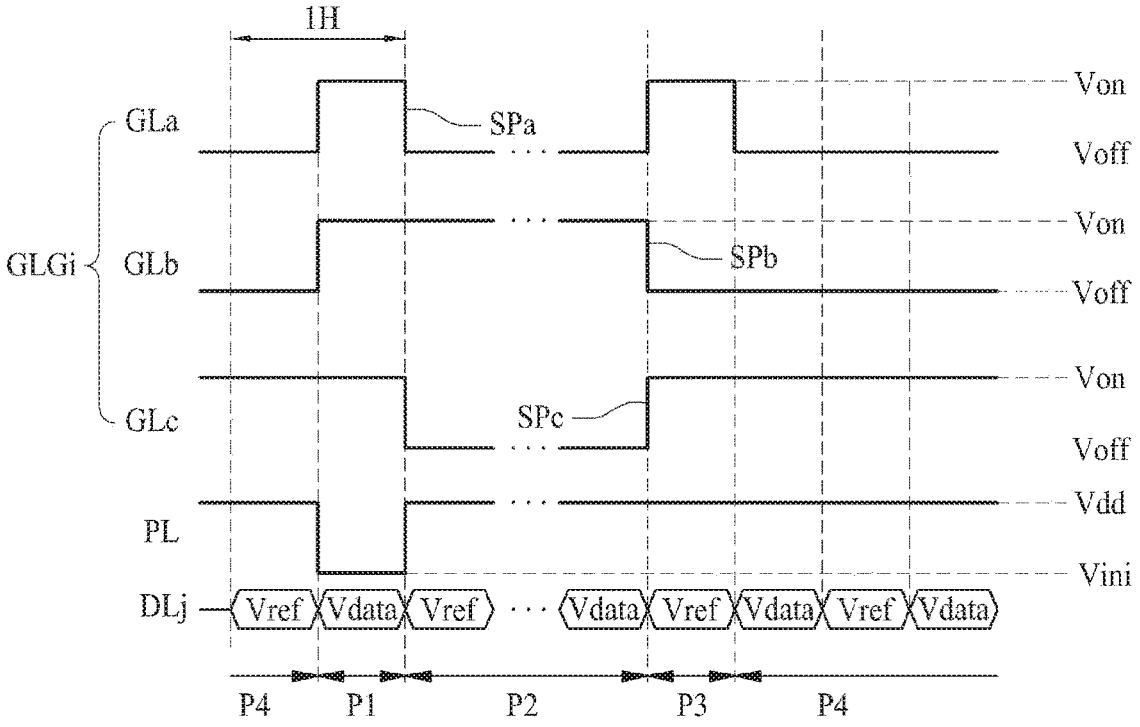
FIG. 9 is a waveform view showing signals supplied to the pixel shown in FIG. 8.

FIG. 9 is a waveform view showing a signal supplied to the pixel shown in FIG. 8, FIGS. 10A to 10D are views illustrating a method of driving the pixel shown in FIG. 8, and FIGS. 11A to 11C are graphs showing a transfer curve characteristic of a driving transistor according to the driving method of a pixel shown in FIG. 8.

Referring to FIG. 9, the pixel P according to an embodiment of the present disclosure may be operated in first to fourth periods P1, P2, P3, and P4. In this case, the first period P1 may be defined as an initialization and programming period (or data writing), the second period P2 may be defined as a threshold voltage sensing period, the third period P3 may be defined as a light emission preparation period (or reference voltage writing), and the fourth period P4 may be defined as a light emission sustaining period. For example, the first period P1 and the third period P3 may be set to a half (H/2) of 1 horizontal period 1H shorter than 1 horizontal period 1H, the second period P2 may be set be longer than the first period P1 and the fourth period P4 may be set to a remaining period excluding the first to third periods P1, P2, and P3 of one frame. Here, the second period P2, which is an period during which a characteristic voltage (or threshold voltage) of the driving transistor Tdr is sensed (or sampled) and stored in the second capacitor C2, may be set to be 2 horizontal periods or greater, more preferably, 19 horizontal periods or greater, to fully sense the characteristic voltage (or the threshold voltage) of the driving transistor Tdr.

First, the pixel P is supplied with the first to third scan pulses SPa, SPb and SPc from the gate line group GLGi. In this case, the first scan pulse SPa may be supplied to the first and fourth switching transistors Tsw1 and Tsw4 of the switching unit through the first gate line GLa of the gate line group GLGi, the second scan pulse SPb may be supplied to the second switching transistor Tsw2 of the switching unit through the second gate line GLb of the gate line group GLGi, and the third scan pulse SPc may be supplied to the third switching transistor Tsw3 of the switching unit through the third gate line GLc of the gate line group GLGi.

Voltage levels of each of the first to third scan pulses SPa, SPb and SPc in each period are substantially the same as those of the first to third scan pulses SPa, SPb and SPc shown in FIG. 4, and thus, a redundant description thereof will be omitted.

The data line DLj connected to the pixel P alternately receives the reference voltage Vref and the data voltage Vdata alternately from the data driving circuit. The pixel driving voltage line PL connected to the pixel P receives the initialization voltage Vini during the first period P1 and the pixel driving voltage Vdd during the second to fourth periods P2, P3, and P4.

Figure 10A:
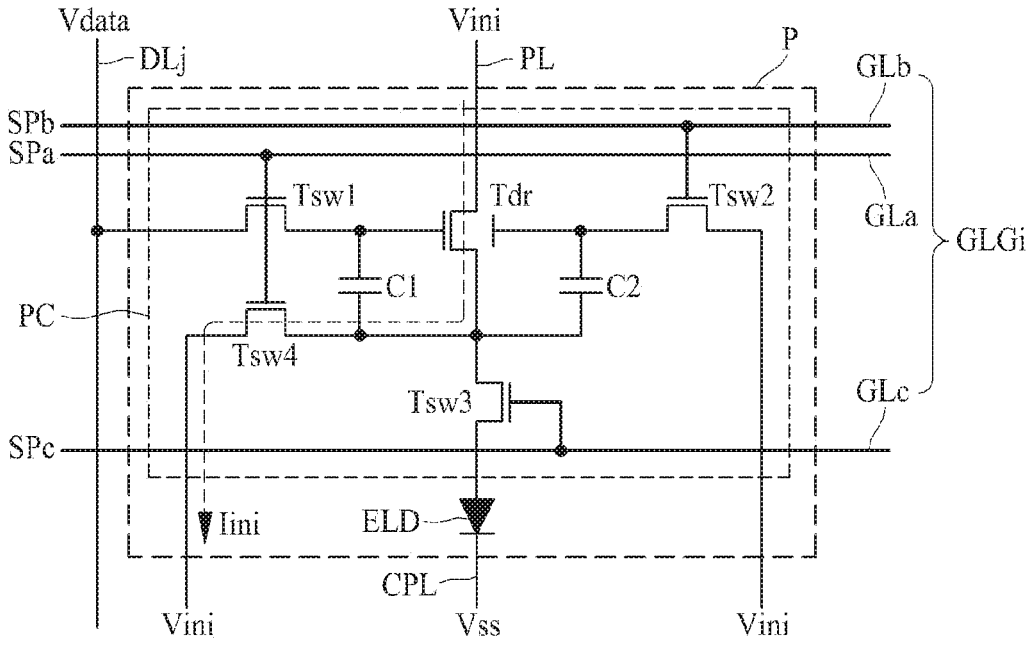
FIGS. 10A to 10D are views illustrating a method of driving the pixel shown in FIG. 8.

Referring to FIGS. 9 and 10A, the first to fourth switching transistors Tsw1, Tsw2, Tsw3, and Tsw4 may be turned on according to the first to third scan pulses SPa, SPb, and SPc having the gate-on voltage level Von in the first period P1 of the pixel P. Also, the actual data voltage Vdata may be supplied to the data line DLj from the data driving circuit and the initialization voltage Vini may be supplied to the pixel driving voltage line PL. Accordingly, the actual data voltage Vdata may be supplied to the first gate electrode of the driving transistor Tdr through the turned-on first switching transistor Tsw1, the initialization data voltage Vini, which is supplied to the pixel driving voltage line PL, may be supplied to the drain electrode of the driving transistor Tdr, the initialization voltage Vini, which is supplied to the initialization voltage line, may be supplied to the second gate electrode of the driving transistor Tdr through the turned-on second switching transistor Tsw2 and simultaneously supplied to the source electrode of the driving transistor Tdr through the turned-on fourth switching transistor Tsw4, and the source electrode of the driving transistor Tdr may be electrically connected to the first electrode of the light emitting device ELD through the turned-on third switching transistor Tsw3 of the driving transistor Tdr. Accordingly, a difference voltage Vdata-Vini between the actual data voltage Vdata supplied to the first gate electrode of the driving transistor Tdr and the initialization voltage Vini supplied to the source electrode of the driving transistor Tdr may be stored in the first capacitor C1. The second capacitor C2 may be initialized to 0 (zero) V by a difference voltage Vini-Vini between the initialization voltage Vini supplied to the second gate electrode of the driving transistor Tdr and the initialization voltage Vini supplied to the source electrode of the driving transistor Tdr. Here, when the initialization voltage Vini is 0 (zero) V, the actual data voltage Vdata may be stored in the first capacitor C1.

In the first period P1 of the pixel P, the driving transistor Tdr is turned on by the first gate voltage and the source voltage, whereby the initial data current Iini based on the voltage difference Vdata-Vini between the actual data voltage Vdata and the initialization voltage Vini may flow to the initialization voltage line through the turned-on fourth switching transistor Tsw4. Here, when the second gate voltage and the source voltage Vbs of the driving transistor Tdr are 0 V, the driving transistor Tdr may be in a turned-on state like the transfer curve characteristic of the driving transistor Tdr shown in FIG. 11A.

Figure 10B:
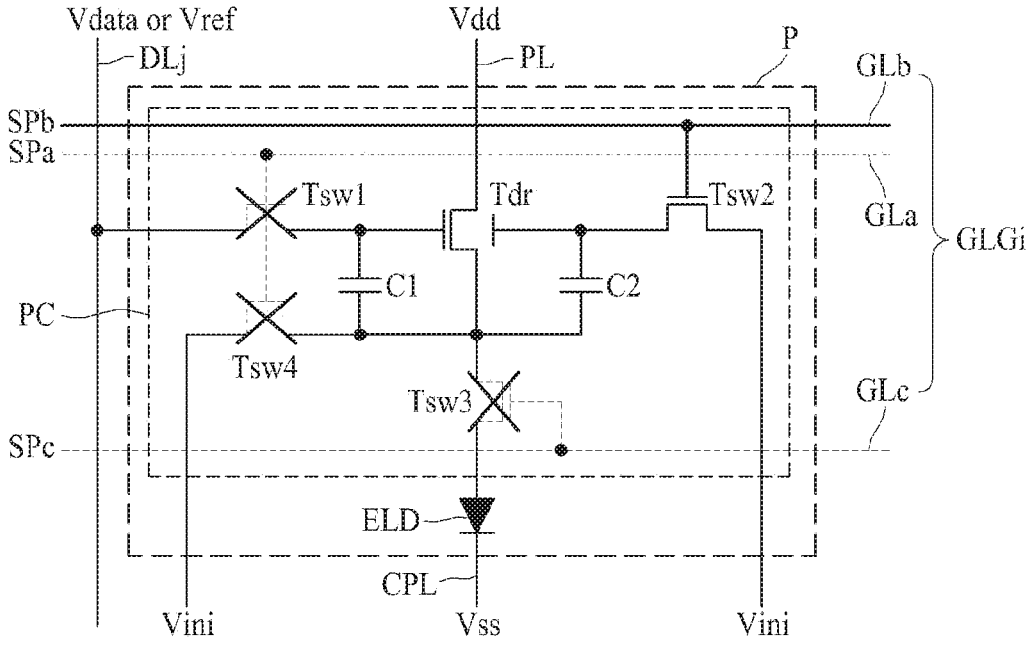

Referring to FIGS. 9 and 10B, in the second period P2 of the pixel P according to an embodiment of the present disclosure, the switching transistor Tsw2 is maintained in a turned-on state according to the second scan pulse SPb maintained at the gate-on voltage level Von, and the first, third and fourth switching transistors Tsw1, Tsw3, and Tsw4 may be turned off according to the first and third scan pulses SPa and SPc having the gate-off voltage level Voff, respectively. The reference voltage Vref and the data voltage Vdata may be alternately supplied from the data driving circuit to the data line DLj and the pixel driving voltage Vdd may be supplied to the pixel driving voltage line PL. Accordingly, the first gate electrode of the driving transistor Tdr is electrically floated due to the turn-off of the first switching transistor Tsw1, the source electrode of the driving transistor Tdr is electrically floated due to the turn-off of the third and fourth switching transistors Tsw3 and Tsw4, and the second gate electrode of the driving transistor Tdr is continuously supplied with the or initialization voltage Vini through the second switching transistor Tsw2 which maintains the turned-on state.

In the second period P2 of the pixel P, the source voltage Vs of the driving transistor Tdr may rise (or increase) to a voltage until the driving transistor Tdr is turned off from the voltage level of the initialization voltage Vini due to the turn-off of the third and fourth switching transistors Tsw3 and Tsw4, the first gate voltage Vg of the driving transistor Tdr is changed to "Vdata-(Vdd-Vs)" due to the turn-off of the first switching transistor Tsw1 and the source voltage Vs of the driving transistor Tdr, and the second gate voltage Vg of the driving transistor Tdr may be maintained at the initialization voltage Vini due to the turned-on state of the second switching transistor Tsw2. Accordingly, the first capacitor C1 may be maintained at "Vdata-Vini" by the first gate voltage-source voltage Vgs of the driving transistor Tdr, and the second capacitor C2 may store "Vini-Vs" by the second gate voltage-source voltage Vbs of the driving transistor Tdr.

In the second period P2 of the pixel P, the driving transistor Tdr is turned off when the source voltage rises (or increases) to a voltage corresponding to a threshold voltage of the driving transistor Tdr from the voltage level of the initialization voltage Vini due to turn-off of the third and fourth switching transistors Tsw3 and Tsw4. That is, the driving transistor Tdr may be turned off when the source voltage Vs is a voltage (Vini-Vth) obtained by subtracting the threshold voltage Vth of the driving transistor Tdr from the initialization voltage Vini. In a state (or condition) in which the difference voltage Vdata-Vini between the actual data voltage Vdata and the initialization voltage Vini is stored in the first capacitor C1 by the first gate voltage-source voltage Vgs of the driving transistor Tdr, the threshold voltage Vth of the driving transistor Tdr at which the driving transistor Tdr is to be turned off may be changed according to the second gate voltage-source voltage Vbs of the driving transistor Tdr as shown in Equation 5 below.

$$Vth_data = Vth + \alpha \times Vbs \quad \text{[Equation 5]}$$

In Equation 5, "a" value refers to a value at which a threshold voltage is varied by a body effect.

Figure 11A:
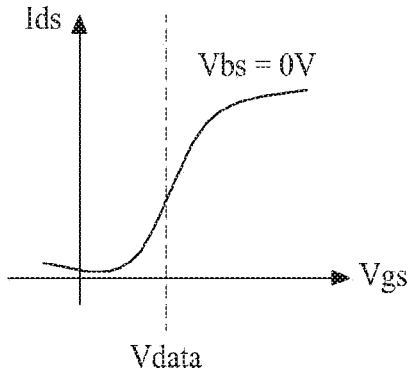
FIGS. 11A to 11C are graphs showing transfer curve characteristics of a driving transistor according to a driving method of the pixel shown in FIG. 8.
Figure 11B:
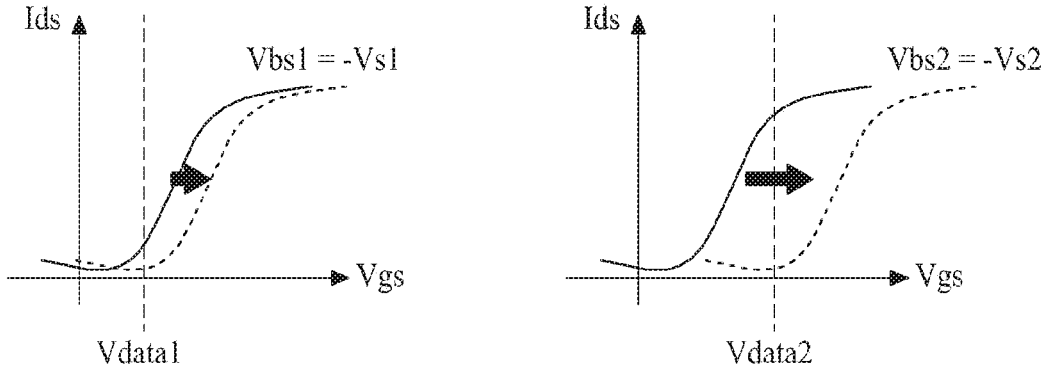

After sensing of the threshold voltage of the driving transistor Tdr is completed according to the second period P2 of the pixel P, "Vth_data" which is the threshold voltage of the driving transistor Tdr is approximately "Vdata-Vini," the second gate voltage-source voltage Vbs of the driving transistor Tdr stored in the second capacitor C2 may be expressed as the original threshold voltage Vth of the actual data voltage Vdata and the driving transistor Tdr as shown in Equation 2 below, and since the second gate voltage-source voltage Vbs of the driving transistor Tdr increases in the negative (−) polarity direction as the actual data voltage Vdata increases, and thus, a transfer curve of the driving transistor Tdr may be significantly shifted to the right as shown in FIG. 11B. For example, when the second data voltage Vdata2 is smaller than the first data voltage Vdata1, the second gate voltage-source voltage Vbs2 of the driving transistor Tdr according to the second data voltage Vdata2 is larger than the second gate voltage-source voltage Vbs1 of the driving transistor Tdr according to the first data voltage Vdata1, and thus, the transfer curve of the driving transistor Tdr corresponding to the second data voltage Vdata2 may be significantly shifted in the positive (+) polarity direction.

$$Vth_data \approx Vdata - Vini$$

$$Vbs = (Vdata - Vini - Vth)/\alpha \quad \text{[Equation 6]}$$

As described above, the second period P2 of the pixel P may last until the source voltage Vs of the driving transistor Tdr completely rises (or increases) to a voltage corresponding to the threshold voltage of the driving transistor Tdr from the voltage level of the initialization voltage Vini. The second period P2 of the pixel P according to an embodiment may last for a time longer than the first period P1. For example, the second period P2 of the pixel P may last for two horizontal periods or longer, and more preferably, for 19 horizontal periods or longer.

Figure 10C:
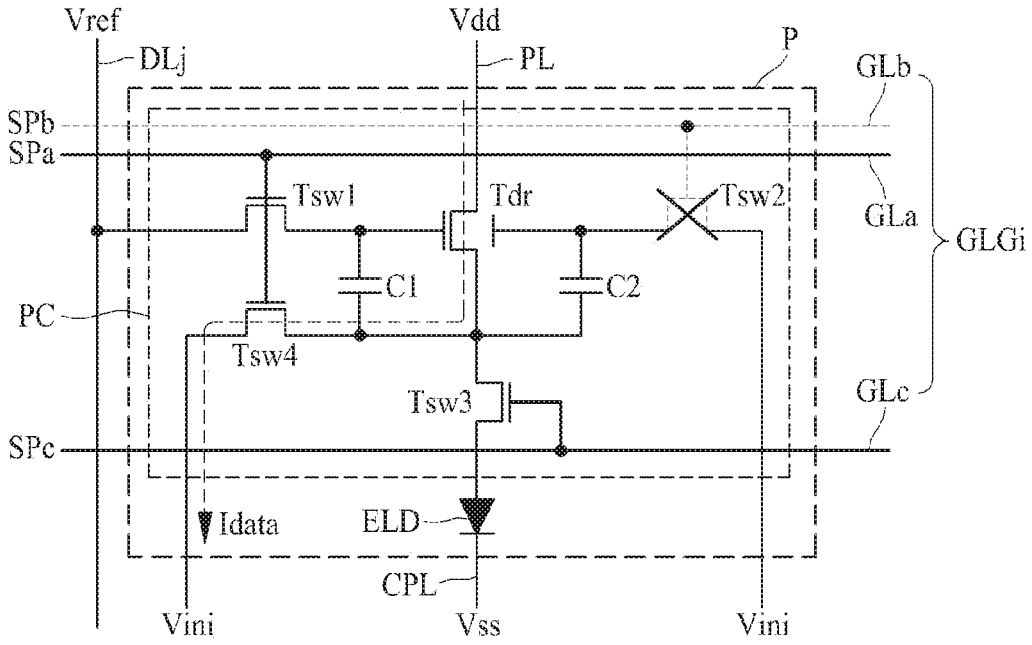

Referring to FIGS. 9 and 10C, in the third period P3 of the pixel P according to an embodiment of the present disclosure, each of the first, third, and fourth switching transistors Tsw1, Tsw3, and Tsw4 may be turned on according to the first and third scan pulses SPa and SPc having the gate-on voltage level Von, and the second switching transistor Tsw2 may be turned off according to the second scan pulse SPb having the gate-off voltage level Voff. The data line DLj may be supplied with the reference voltage Vref from the data driving circuit, and the pixel driving voltage line PL may be supplied with the pixel driving voltage Vdd. The first gate electrode of the driving transistor Tdr is supplied with the reference voltage Vref through the turned-on first switching transistor Tsw1, the second gate electrode of the driving transistor Tdr is electrically floated due to turn-off of the second switching transistor Tsw2, and the source electrode of the driving transistor Tdr may be electrically connected to the first electrode of the light emitting device ELD and electrically connected to the initialization voltage line through the turned-on fourth switching transistor Tsw4. Therefore, the voltage of the first capacitor C1 is changed to "Vref-Vini" by the first gate voltage-source voltage Vgs of the driving transistor Tdr, and the voltage of the second capacitor C2 may be maintained as "Vini-Vs" by the second gate voltage-source voltage Vbs of the driving transistor Tdr.

In the third period P3 of the pixel P, the driving transistor Tdr is turned on by the first gate voltage-source voltage Vgs to output the data current Idata as shown in Equation 7 below, and the data current Idata output from the driving transistor Tdr may flow to the initialization voltage line through the turned-on fourth switching transistor Tsw4 so that the light emitting device ELD may not emit light.

$$Idata = k(Vref - |Vth_data|)^2 \quad \text{[Equation 7]}$$

In Equation 7, "k" refers to a constant determined according to mobility and parasitic capacitance of the driving transistor Tdr.

After sensing of the threshold voltage in the second period P2 of the pixel P, if the threshold voltage Vth_data of the driving transistor Tdr is "Vdata-Vini" and the initialization voltage Vini is 0 (zero) V, the driving transistor Tdr may output the data current Idata based on the difference voltage (Vref-Vdata) between the reference voltage Vref and the actual data voltage Vdata.

$$Vth_data \approx Vdata - Vini$$

$$Idata \approx k(Vref - Vdata - 0)^2$$

$$Idata \approx k(Vref - Vdata)^2 \quad \text{[Equation 8]}$$

Figure 11C:
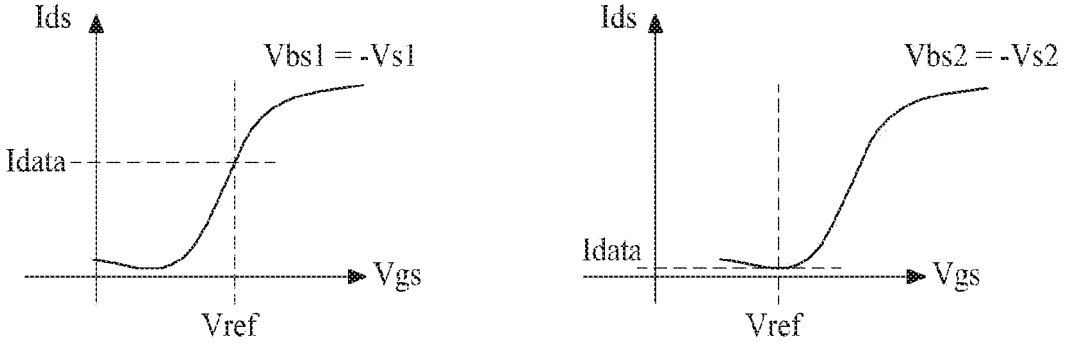

As shown in Equation 8, it can be seen that the data current Idata output from the driving transistor Tdr is not affected by the pixel driving voltage Vdd and the threshold voltage Vth of the driving transistor Tdr and is affected by the difference voltage Vref-Vdata between the reference voltage Vref and the data voltage Vdata. In this case, a magnitude of the data current Idata may vary depending on the second gate voltage-source voltage Vbs of the driving transistor Tdr. That is, since the second gate voltage-source voltage Vbs of the driving transistor Tdr is close to 0 V as the actual data voltage Vdata is larger, the data current Idata may have a greater value when the first gate voltage Vg of the driving transistor Tdr is equal to the reference voltage Vref as shown in FIG. 11C.

Figure 10D:
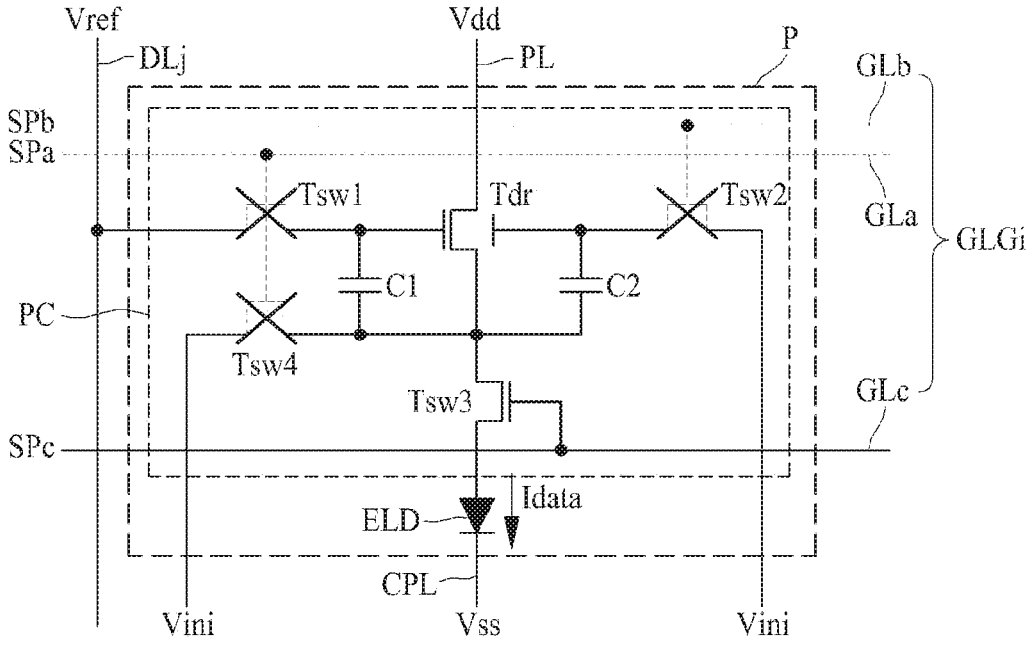

Referring to FIGS. 9 and 10D, in a fourth period P4 of the pixel P according to an embodiment of the present disclosure, the third switching transistor Tsw3 is kept in the turned-on state according to the third scan pulse SPc maintaining the gate-on voltage level Von, the second switching transistor Tsw2 is kept in the turned-off state according to the second scan pulse SPb maintaining the gate-off voltage level Voff, and the first and fourth switching transistor Tsw1 and Tsw4 may be turned off according to the first scan pulse SPa having the gate-off voltage level Voff. The data voltage Vdata and the reference voltage Vref may be alternately supplied from the data driving circuit to the data line DLj and the pixel driving voltage Vdd may be supplied to the pixel driving voltage line PL. Accordingly, the first gate electrode of the driving transistor Tdr is electrically floated by the turn-off of the first switching transistor Tsw1, the second gate electrode of the driving transistor Tdr is kept in the electrically floated state due to the turned-off state of the second switching transistor Tsw2, the drain electrode of the driving transistor Tdr is continuously supplied with the pixel driving voltage Vdd from the pixel driving voltage line PL, and the source electrode of the driving transistor Tdr may be electrically connected to the first electrode of the light emitting device ELD through the third switching transistor Tsw3 held in the turned-on state. Therefore, the driving transistor Tdr is turned on by the first gate voltage-source voltage Vgs to supply the data current Idata to the light emitting device ELD on the basis of the difference voltage Vref-Vdata between the reference voltage Vref and the data voltage Vdata, and accordingly, the light emitting device ELD may emit light by the data current Idata supplied from the driving transistor Tdr.

Since the first gate voltage of the driving transistor Tdr changes together with the source voltage in the fourth period P4 of the pixel P, the voltage of the first capacitor C1 may be held at "Vref-Vdd" by the first gate voltage-source voltage Vgs of the driving transistor Tdr and the voltage of the second capacitor C2 may be held at "Vini-Vs" by the second gate voltage-source voltage Vbs of the driving transistor Tdr.

In the fourth period P4 of the pixel P, the driving transistor Tdr is kept in the turned-on state by the first gate voltage-source voltage Vgs, thereby outputting the data voltage Idata as expressed by Equation 8, and thus, the light emitting device ELD may kept emitting light by the data current Idata.

The light emitting display apparatus according to another example of the present disclosure may have the same effect as the light emitting display apparatus according to one embodiment of the present disclosure.

The pixel according to the present disclosure may be described as follows.

A pixel according to an embodiment of the present discourse includes a light emitting device, and a pixel circuit connected to the light emitting device, wherein the pixel circuit includes: a driving transistor including first and second gate electrodes, a source electrode, and a drain electrode, a first capacitor formed between the first gate electrode and the source electrode of the driving transistor, a second capacitor formed between the second gate electrode and the source electrode of the driving transistor, and a switching unit connected to the first and second gate electrodes, the source electrode, and the drain electrode of the driving transistor and operating in order of first to fourth period, wherein the switching unit supplies a data voltage to the first capacitor and supplies an initialization voltage to the second capacitor during the first period, floats each of the first gate electrode and the source electrode of the driving transistor and supplies the initialization voltage to the second gate electrode of the driving transistor during the second period, supplies a reference voltage to the first gate electrode of the driving transistor and supplies a pixel driving voltage to the drain electrode of the driving transistor during the third period, and floats each of the first gate electrode and the second gate electrode of the driving transistor and supplies the pixel driving voltage to the drain electrode of the driving transistor during the fourth period.

The second period may be longer than the first period.

The drain electrode of the driving transistor according to an embodiment of the present discourse may be connected to the light emitting device, and the switching unit includes a first switching transistor supplying the data voltage to the first gate electrode of the driving transistor in the first period and supplying the reference voltage to the first gate electrode of the driving transistor in the third period, a second switching transistor supplying the initialization voltage to the second gate electrode of the driving transistor in each of the first period and the second period, and a third switching transistor supplying the pixel driving voltage to the source electrode of the driving transistor in each of the first period, the third period, and the fourth period The initialization voltage according to an embodiment of the present discourse may have the same voltage level as the pixel driving voltage.

Each of the driving transistor and the first to third switching transistors according to an embodiment of the present discourse may be a P-channel type transistor.

Each of the first to third switching transistors according to an embodiment of the present discourse may include a gate electrode, first source/drain electrode, and second source/drain electrode, and at least one of the first to third switching transistors may further include a back gate electrode overlapping the gate electrode and supplied with the pixel driving voltage.

The drain electrode of the driving transistor according to an embodiment of the present discourse may be supplied with the initialization voltage in the first period and may be supplied with the pixel driving voltage in the second to fourth periods, and the switching unit may include a first switching transistor supplying the data voltage to the first gate electrode of the driving transistor in the first period and supplying the reference voltage to the first gate electrode of the driving transistor in the third period, a second switching transistor supplying the initialization voltage to the second gate electrode of the driving transistor in each of the first period and the second period, a third switching transistor electrically connecting the source electrode of the driving transistor to the light emitting device in each of the first period, the third period, and the fourth period, and a fourth switching transistor supplying the initialization voltage to the source electrode of the driving transistor in each of the first period and the third period.

The initialization voltage according to an embodiment of the present discourse may have the same voltage level as a common cathode voltage supplied to the light emitting device or is ground voltage.

Each of the driving transistor and the first to fourth switching transistors according to an embodiment of the present discourse may be an N-channel type transistor.

Each of the first to fourth switching transistors according to an embodiment of the present discourse may include a gate electrode, a first source/drain electrode, and a second source/drain electrode, and at least one of the first to fourth switching transistors may further include a back gate electrode overlapping the gate electrode and supplied with the initialization voltage.

Each of the first period and the third period according to an embodiment of the present discourse may be shorter than 1 horizontal period, and the second period may be equal to or greater than 2 horizontal periods.

The first capacitor according to an embodiment of the present discourse may store the data voltage, and the second capacitor may store a characteristic voltage of the driving transistor.

The first capacitor according to an embodiment of the present discourse may store a difference voltage between the data voltage and the reference voltage, and the second capacitor may store a threshold voltage of the driving transistor.

The driving transistor according to an embodiment of the present discourse may include a capacitor electrode pattern disposed on a substrate, a first interlayer insulating layer covering the capacitor electrode pattern, the second gate electrode disposed on the first interlayer insulating layer overlapping the capacitor electrode pattern, a first gate insulating layer covering the second gate electrode and the first interlayer insulating layer, a semiconductor layer disposed on the first gate insulating layer overlapping the second gate electrode and having a source region, a channel region, and a drain region, a second gate insulating layer covering the semiconductor layer, the first gate electrode disposed on the second gate insulating layer overlapping the channel region of the semiconductor layer, a second interlayer insulating layer covering the second gate electrode and the second gate insulating layer, the drain electrode disposed on the second insulating layer overlapping the drain region of the semiconductor layer and electrically connected to the drain region of the semiconductor layer, and the source electrode disposed on the second interlayer insulating layer overlapping the first gate electrode and electrically connected to each of the source region of the semiconductor layer and the capacitor electrode pattern, wherein the first capacitor is formed in an overlap region of the first gate electrode and the source electrode, and the second capacitor is formed in an overlap region of the capacitor electrode pattern and the second gate electrode.

A light emitting display apparatus according to an embodiment of the present discourse may be described as follows.

The emitting display apparatus according to an embodiment of the present discourse includes a display panel configured to have pixels, a data driving circuit supplying a data voltage or a reference voltage to each of the pixels, and a gate driving circuit supplying a scan pulse for operating the pixels in order of the first to fourth periods to the pixels, wherein the pixel includes: a light emitting device; and a pixel circuit connected to the light emitting device, wherein the pixel circuit includes: a driving transistor including first and second gate electrodes, a source electrode, and a drain electrode; a first capacitor formed between the first gate electrode and the source electrode of the driving transistor; a second capacitor formed between the second gate electrode and the source electrode of the driving transistor; and a switching unit connected to the first and second gate electrodes, the source electrode, and the drain electrode of the driving transistor and operating in order of first to fourth period, wherein the switching unit supplies a data voltage to the first capacitor and supplies an initialization voltage to the second capacitor during the first period, floats each of the first gate electrode and the source electrode of the driving transistor and supplies the initialization voltage to the second gate electrode of the driving transistor during the second period, supplies a reference voltage to the first gate electrode of the driving transistor and supplies a pixel driving voltage to the drain electrode of the driving transistor during the third period, and floats each of the first gate electrode and the second gate electrode of the driving transistor and supplies the pixel driving voltage to the drain electrode of the driving transistor during the fourth period.

Each of the first period and the third period according to an embodiment of the present discourse may be shorter than 1 horizontal period, and the second period may be equal to or greater than 2 horizontal periods.

The data driving circuit according to an embodiment of the present discourse may supply the data voltage to the pixels during a first sub-horizontal period of each horizontal period, and supply the reference voltage to the pixels during a second sub-horizontal period of each horizontal period.

The first capacitor according to an embodiment of the present discourse may store the data voltage, and the second capacitor may store a characteristic voltage of the driving transistor.

The driving transistor of each of the pixels according to an embodiment of the present discourse may include a capacitor electrode pattern disposed on a substrate, a first interlayer insulating layer covering the capacitor electrode pattern, the second gate electrode disposed on the first interlayer insulating layer overlapping the capacitor electrode pattern, a first gate insulating layer covering the second gate electrode and the first interlayer insulating layer, a semiconductor layer disposed on the first gate insulating layer overlapping the second gate electrode and having a source region, a channel region, and a drain region, a second gate insulating layer covering the semiconductor layer, the first gate electrode disposed on the second gate insulating layer overlapping the channel region of the semiconductor layer, a second interlayer insulating layer covering the second gate electrode and the second gate insulating layer, the drain electrode disposed on the second insulating layer overlapping the drain region of the semiconductor layer and electrically connected to the drain region of the semiconductor layer, and the source electrode disposed on the second interlayer insulating layer overlapping the first gate electrode and electrically connected to each of the source region of the semiconductor layer and the capacitor electrode pattern, wherein the first capacitor is formed in an overlap region of the first gate electrode and the source electrode, and the second capacitor is formed in an overlap region of the capacitor electrode pattern and the second gate electrode.

The above-described feature, structure, and effect of the present disclosure are included in at least an embodiment of the present disclosure, but are not limited to only an embodiment. Furthermore, the feature, structure, and effect described in at least an embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A pixel, comprising:

a light emitting device; and a pixel circuit connected to the light emitting device, wherein the pixel circuit comprises:

a driving transistor including first and second gate electrodes, a source electrode, and a drain electrode;

a first capacitor formed between the first gate electrode and the source electrode of the driving transistor;

a second capacitor formed between the second gate electrode and the source electrode of the driving transistor; and switching circuitry comprising a first switching transistor connected to the first gate electrode of the driving transistor, a second switching transistor connected to the second gate electrode of the transistor, and a third switching transistor connected to the source electrode of the driving transistor, the switching circuitry configured to operate in order of a first to a fourth period, wherein, in operation, the switching circuitry:

supplies a data voltage to the first capacitor through the first switching transistor and supplies an initialization voltage to the second capacitor through the second switching transistor during the first period;

electrically floats each of the first gate electrode and the source electrode of the driving transistor by turning off the first switching transistor and the third switching transistor and supplies the initialization voltage to the second gate electrode of the driving transistor through the second switching transistor during the second period;

supplies a reference voltage to the first gate electrode of the driving transistor through the first switching transistor and supplies a pixel driving voltage to the drain electrode of the driving transistor through the third switching transistor during the third period; and electrically floats each of the first gate electrode and the second gate electrode of the driving transistor by turning off the first switching transistor and the second switching transistor and supplies the pixel driving voltage to the drain electrode of the driving transistor through the third switching transistor during the fourth period.

2. The pixel of claim 1, wherein the second period is longer than the first period.

3. The pixel of claim 2, wherein the drain electrode of the driving transistor is connected to the light emitting device, and wherein:

the first switching transistor that-supplies the data voltage to the first gate electrode of the driving transistor in the first period and supplies the reference voltage to the first gate electrode of the driving transistor in the third period, and is turned off during the third period;

the second switching transistor supplies the initialization voltage to the second gate electrode of the driving transistor in each of the first period and the second period, and is turned off during the third period and the fourth period; and the third switching transistor that-supplies the pixel driving voltage to the source electrode of the driving transistor in each of the first period, the third period and the fourth period, and is turned off during the second period.

4. The pixel of claim 3, wherein the initialization voltage has a same voltage level as the pixel driving voltage.

5. The pixel of claim 4, wherein each of the driving transistor and the first, second, and third switching transistors is a P-channel type transistor.

6. The pixel of claim 5, wherein each of the first, second, and third switching transistors comprises a gate electrode, a source electrode, and a drain electrode, and wherein at least one of the first, second, or third switching transistors further comprises a back gate electrode overlapping the gate electrode, and the back gate electrode is supplied with the pixel driving voltage.

7. The pixel of claim 2, wherein the drain electrode of the driving transistor is supplied with the initialization voltage in the first period and is supplied with the pixel driving voltage in the second to fourth periods, wherein the switching circuitry further comprises:

a fourth switching transistor connected to the source electrode of the driving transistor, and wherein:

the first switching transistor supplies the data voltage to the first gate electrode of the driving transistor in the first period and supplies the reference voltage to the first gate electrode of the driving transistor in the third period, and is turned off during the third period;

the second switching transistor supplies the initialization voltage to the second gate electrode of the driving transistor in each of the first period and the second period, and is turned off during the third period and the fourth period;

the third switching transistor electrically connects the source electrode of the driving transistor to the light emitting device in each of the first period, the third period and the fourth period, and is turned off during the second period; and the fourth switching transistor that supplies the initialization voltage to the source electrode of the driving transistor in each of the first period and the third period, and is turned off during the second period and the fourth period.

8. The pixel of claim 7, wherein the initialization voltage has a same voltage level as a common cathode voltage supplied to the light emitting device or a ground voltage.

9. The pixel of claim 7, wherein each of the driving transistor and the first, second, third, and fourth switching transistors is an N-channel type transistor.

10. The pixel of claim 9, wherein each of the first, second, third, and fourth switching transistors comprises a gate electrode, a source electrode, and a drain electrode, and wherein at least one of the first, second, third, or fourth switching transistors further comprises a back gate electrode overlapping the gate electrode, and the back gate electrode is supplied with the initialization voltage.

11. The pixel of claim 1, wherein each of the first period and the third period is shorter than 1 horizontal period, and wherein the second period is equal to or greater than 2 horizontal periods.

12. The pixel of claim 1, wherein the first capacitor stores the data voltage, and wherein the second capacitor stores a characteristic voltage of the driving transistor.

13. The pixel of claim 1, wherein the first capacitor stores a difference voltage between the data voltage and the reference voltage, and wherein the second capacitor stores a threshold voltage of the driving transistor.

14. The pixel of claim 1, wherein the driving transistor comprises:

a capacitor electrode pattern disposed on a substrate;

a first interlayer insulating layer covering the capacitor electrode pattern;

the second gate electrode disposed on the first interlayer insulating layer overlapping the capacitor electrode pattern;

a first gate insulating layer covering the second gate electrode and the first interlayer insulating layer;

a semiconductor layer disposed on the first gate insulating layer overlapping the second gate electrode and having a source region, a channel region, and a drain region;

a second gate insulating layer covering the semiconductor layer;

the first gate electrode disposed on the second gate insulating layer overlapping the channel region of the semiconductor layer;

a second interlayer insulating layer covering the second gate electrode and the second gate insulating layer;

the drain electrode disposed on the second insulating layer overlapping the drain region of the semiconductor layer and electrically connected to the drain region of the semiconductor layer; and the source electrode disposed on the second interlayer insulating layer overlapping the first gate electrode and electrically connected to each of the source region of the semiconductor layer and the capacitor electrode pattern, wherein the first capacitor is formed in an overlap region of the first gate electrode and the source electrode, and the second capacitor is formed in an overlap region of the capacitor electrode pattern and the second gate electrode.

15. A light emitting display apparatus, comprising:

a display panel having a plurality of pixels, each of the pixels comprising:

a light emitting device; and a pixel circuit connected to the light emitting device, the pixel circuit including:

a driving transistor including first and second gate electrodes, a source electrode, and a drain electrode;

a first capacitor formed between the first gate electrode and the source electrode of the driving transistor;

a second capacitor formed between the second gate electrode and the source electrode of the driving transistor; and switching circuitry comprising a first switching transistor connected to the first gate electrode of the driving transistor, a second switching transistor connected to the second gate electrode of the driving transistor, and a third switching transistor connected to the source electrode of the driving transistor, the switching circuitry configured to operate in order of a first to a fourth period;

a data driving circuit configured to supply a data voltage or a reference voltage to each of the pixels; and a gate driving circuit configured to supply a scan pulse for operating the pixels in order of the first to fourth periods to the pixels, wherein, in operation, the switching circuitry:

supplies the data voltage to the first capacitor through the first switching transistor and supplies an initialization voltage to the second capacitor through the second switching transistor during the first period;

electrically floats each of the first gate electrode and the source electrode of the driving transistor by turning off the first switching transistor and the third switching transistor and supplies the initialization voltage to the second gate electrode of the driving transistor through the second switching transistor during the second period;

supplies the reference voltage to the first gate electrode of the driving transistor through the first switching transistor and supplies a pixel driving voltage to the drain electrode of the driving transistor through the third switching transistor during the third period; and electrically floats each of the first gate electrode and the second gate electrode of the driving transistor by turning off the first switching transistor and the second switching transistor and supplies the pixel driving voltage to the drain electrode of the driving transistor through the third switching transistor during the fourth period.

16. The light emitting display apparatus of claim 15, wherein each of the first period and the third period is shorter than 1 horizontal period, and wherein the second period is equal to or greater than 2 horizontal periods.

17. The light emitting display apparatus of claim 15, wherein the data driving circuit supplies the data voltage to the pixels during a first sub-horizontal period of each horizontal period, and supplies the reference voltage to the pixels during a second sub-horizontal period of each horizontal period.

18. The light emitting display apparatus of claim 15, wherein the first capacitor stores the data voltage, and wherein the second capacitor stores a characteristic voltage of the driving transistor.

19. The light emitting display apparatus of claim 15, wherein the first capacitor stores a difference voltage between the data voltage and the reference voltage, and wherein the second capacitor stores a threshold voltage of the driving transistor.

20. The light emitting display apparatus of claim 15, wherein the driving transistor of each of the pixels comprises:

a capacitor electrode pattern disposed on a substrate;

a first interlayer insulating layer covering the capacitor electrode pattern;

the second gate electrode disposed on the first interlayer insulating layer overlapping the capacitor electrode pattern;

a first gate insulating layer covering the second gate electrode and the first interlayer insulating layer;

a semiconductor layer disposed on the first gate insulating layer overlapping the second gate electrode and having a source region, a channel region, and a drain region;

a second gate insulating layer covering the semiconductor layer;

the first gate electrode disposed on the second gate insulating layer overlapping the channel region of the semiconductor layer;

a second interlayer insulating layer covering the second gate electrode and the second gate insulating layer;

the drain electrode disposed on the second insulating layer overlapping the drain region of the semiconductor layer and electrically connected to the drain region of the semiconductor layer; and the source electrode disposed on the second interlayer insulating layer overlapping the first gate electrode and electrically connected to each of the source region of the semiconductor layer and the capacitor electrode pattern, wherein the first capacitor is formed in an overlap region of the first gate electrode and the source electrode, and the second capacitor is formed in an overlap region of the capacitor electrode pattern and the second gate electrode.

* * * * *